US011425976B1

(12) United States Patent
Tran et al.

(10) Patent No.: US 11,425,976 B1
(45) Date of Patent: Aug. 30, 2022

(54) MONEY CLIP

(71) Applicant: Dango Products, LLC, Portola Valley, CA (US)

(72) Inventors: Thuan Tran, Santa Clara, CA (US); Charlie Carroll, Palo Alto, CA (US); Binh Tran, Santa Clara, CA (US)

(73) Assignee: Dango Products, LLC, Portola Valley, CA (US)

( * ) Notice: Subject to any disclaimer, the term of this patent is extended or adjusted under 35 U.S.C. 154(b) by 0 days.

(21) Appl. No.: 17/489,015

(22) Filed: Sep. 29, 2021

(51) Int. Cl.
*A45C 1/06* (2006.01)

(52) U.S. Cl.
CPC ..... *A45C 1/06* (2013.01); *A45C 2001/062* (2013.01)

(58) Field of Classification Search
CPC ..... A45C 1/06; A45C 2001/062
USPC ..... 150/132, 147; 81/309, 3.09
See application file for complete search history.

(56) References Cited

U.S. PATENT DOCUMENTS

| | | | |
|---|---|---|---|
| D187,240 | S | 2/1960 | Harkins |
| 3,461,469 | A | 8/1969 | Morrision |
| D266,479 | S | 10/1982 | Hayakawa |
| 4,705,086 | A | 11/1987 | O'Neill |
| 4,763,821 | A | 8/1988 | Powell |
| 4,932,520 | A | 6/1990 | Ciarcia |
| D314,865 | S | 2/1991 | Tuisku |
| D322,039 | S | 12/1991 | Chien |
| 5,077,869 | A | 1/1992 | Haase |
| D337,656 | S | 7/1993 | Hostert |
| 5,279,019 | A | 1/1994 | Knickle |
| 5,328,026 | A | 7/1994 | Newman |
| D360,815 | S | 8/1995 | Padden |

(Continued)

FOREIGN PATENT DOCUMENTS

| | | |
|---|---|---|
| CA | 2471793 | 6/2003 |
| KR | 101356236 | 1/2014 |
| KR | 20140003803 U | 6/2014 |

OTHER PUBLICATIONS

Dango Products—"Wallet Collections"—Available from Internet <URL: www.dangoproducts.com/collections/wallets>—Available at least as of Oct. 19, 2017—Retrieved from Internet Archive Wayback Machine <URL: https://web.archive.org/web/20171019082039/www.dangoproducts.com/collections/wallets> on Oct. 23, 2020.

(Continued)

*Primary Examiner* — Sue A Weaver
(74) *Attorney, Agent, or Firm* — Wesley E. Schwie, Esq.; Gallium Law; Isabel Fox

(57) ABSTRACT

The disclosure includes a money clip comprising a chassis defining a first side, and a second side located opposite the first side, and a curved member mechanically coupled to the second side of the chassis adjacent a top portion, the curved member configured to curve around the top portion to the first side of the chassis. The money clip may also comprise a stretchable band configured to wrap around the chassis, a first portion of the stretchable band located between the first side of the chassis and the curved member and a second portion of the stretchable band located on the second side of the chassis. The money clip may be configured to receive at least one personal card and/or at least one paper bill between the curved member and the first side of the chassis, and between the stretchable band and the second side of the chassis.

20 Claims, 11 Drawing Sheets

(56) References Cited

U.S. PATENT DOCUMENTS

D366,146 S 1/1996 Bertrand
D374,388 S 10/1996 Padden
D384,499 S 10/1997 Gaestel
D398,446 S 9/1998 Hosea
D404,567 S 1/1999 Akutsu
5,944,080 A 8/1999 Podwika
D416,581 S 11/1999 Cheng
6,009,584 A 1/2000 Padden
6,044,967 A 4/2000 Painsith
6,076,665 A 6/2000 Chuang
D431,105 S 9/2000 Ling
6,145,994 A 11/2000 Ng
D434,624 S 12/2000 Padden
6,276,414 B1 5/2001 Bibb
D444,060 S 6/2001 Elsener
D447,438 S 9/2001 Dilibero
6,347,875 B1 2/2002 Painsith
D462,000 S 8/2002 Hightower
6,427,837 B1 8/2002 Shields
6,460,698 B1 10/2002 Wang
6,823,910 B1 11/2004 Elnekaveh
6,851,147 B2 2/2005 Abrahall
D517,390 S 3/2006 Cheng
D525,162 S 7/2006 Suman
7,334,616 B2 2/2008 Kaminski
7,556,073 B2 7/2009 Lyons
7,568,250 B2 * 8/2009 Menard-Flanagan ..... B25H 3/006 24/3.12
7,604,028 B2 10/2009 Bridgefarmer
7,918,335 B1 4/2011 Kitchen
7,971,324 B2 7/2011 Preston-Hall
8,251,210 B2 8/2012 Schmidt
D685,990 S 7/2013 Zhang
D690,931 S 10/2013 Minn
8,567,459 B2 10/2013 Kitchen
D695,013 S 12/2013 Minn
D701,043 S 3/2014 Minn
8,726,952 B2 5/2014 Jambunathan
D707,091 S 6/2014 Barr
8,763,795 B1 7/2014 Oten
8,776,846 B1 7/2014 Thompson
D716,043 S 10/2014 Wilk
8,863,793 B2 10/2014 Black
D718,525 S 12/2014 Kim
9,125,464 B2 9/2015 Minn
9,125,465 B2 9/2015 Beckley
D743,760 S 11/2015 Barr
D745,274 S 12/2015 Minn
D751,877 S 3/2016 Shlaferman
D755,764 S 5/2016 Dong
9,339,094 B2 5/2016 Tucker-Skow
D765,487 S 9/2016 Barr
D768,382 S 10/2016 Wu
D768,383 S 10/2016 Wu
D770,775 S 11/2016 Robertson
D772,678 S 11/2016 Haarburger
D775,824 S 1/2017 King
D780,449 S 3/2017 King
9,648,931 B2 5/2017 Sha
9,661,908 B2 5/2017 Mayer
D792,749 S 7/2017 Faro
D798,591 S 10/2017 King
D799,301 S 10/2017 Cetera
9,775,328 B1 10/2017 Fidrych
9,815,212 B2 11/2017 Barr
D805,770 S 12/2017 Justiss
D805,873 S 12/2017 Cetera
D806,386 S 1/2018 King
D808,158 S 1/2018 King
D808,765 S 1/2018 Kisling
D809,792 S 2/2018 Moon
9,907,375 B1 3/2018 Kitchen
D814,182 S 4/2018 Haarburger
D814,183 S 4/2018 Haarburger
D815,932 S 4/2018 Lee
D815,935 S 4/2018 Barak
D817,196 S 5/2018 Haarburger
D817,316 S 5/2018 Srour
D827,408 S 9/2018 Stefanczyk-Lacor
10,080,409 B2 9/2018 King
D831,349 S 10/2018 Deng
10,123,596 B2 11/2018 King
D835,408 S 12/2018 Justiss
D835,409 S 12/2018 Justiss
D835,410 S 12/2018 Chan
10,206,473 B2 2/2019 Haarburger
D842,070 S 3/2019 Kisling
D845,623 S 4/2019 Sullivan
D856,956 S 8/2019 Liu
10,368,618 B2 8/2019 Richards
D860,645 S 9/2019 Wu
D861,339 S 10/2019 Moon
D866,177 S 11/2019 Leh
D866,178 S 11/2019 Jin
D866,276 S 11/2019 Shlaferman
D866,964 S 11/2019 Tran
D868,463 S 12/2019 Tran
10,512,316 B2 12/2019 Haarburger
D875,490 S 2/2020 Barr
D877,513 S 3/2020 Duncan
D877,594 S 3/2020 Liang
D878,891 S 3/2020 Polczynski
D878,893 S 3/2020 Kao
D879,580 S 3/2020 Spater
10,595,611 B2 3/2020 Berkley
D881,671 S 4/2020 Kao
D884,339 S 5/2020 Li
D884,792 S 5/2020 Swallow
D887,708 S 6/2020 Tran
D887,709 S 6/2020 Fenton
D890,525 S 7/2020 Leh
D891,767 S 8/2020 Lamb
D893,975 S 8/2020 Tran
D895,276 S 9/2020 Leh
D895,961 S 9/2020 Swan
D895,963 S 9/2020 Anderson
D896,506 S 9/2020 Anderson
10,791,808 B2 10/2020 Kane
D904,016 S 12/2020 Jacobsen
D904,143 S 12/2020 Hollinger
D908,351 S 1/2021 Hoffman
D908,352 S 1/2021 Pirker
D909,059 S 2/2021 Leh
D915,765 S 4/2021 Quittner
D917,879 S 5/2021 Chui
D918,002 S 5/2021 Borenstein
D930,981 S 9/2021 Ghazzaoui
D932,182 S 10/2021 Foy
D933,360 S 10/2021 Qing
D934,560 S 11/2021 Tran
11,178,947 B2 11/2021 Tran
2002/0179463 A1 12/2002 Newman
2004/0148837 A1 8/2004 Lewis
2005/0035006 A1 2/2005 Dohner
2008/0314483 A1 12/2008 Armstrong
2009/0199940 A1 8/2009 Toner
2012/0228168 A1 9/2012 Kitchen
2013/0056119 A1 3/2013 Henriette
2013/0276943 A1 10/2013 Minn et al.
2014/0143958 A1 5/2014 Barr
2015/0240524 A1 8/2015 Olroyd
2015/0257499 A1 9/2015 Muir
2015/0282579 A1 10/2015 Piro
2016/0324283 A1 11/2016 Kane
2016/0374443 A1 12/2016 Kim
2017/0035169 A1 2/2017 Haarburger
2017/0055654 A1 3/2017 King
2017/0119115 A1 5/2017 King
2017/0135452 A1 5/2017 Kane
2017/0224077 A1 8/2017 Mayer
2017/0265610 A1 9/2017 Smith
2018/0027935 A1 2/2018 Laatz
2018/0064223 A1 3/2018 Singer

(56) References Cited

U.S. PATENT DOCUMENTS

| | | | |
|---|---|---|---|
| 2018/0325228 | A1 | 11/2018 | Leimer |
| 2019/0008253 | A1 | 1/2019 | Deng |
| 2019/0318667 | A1 | 10/2019 | Freeman |
| 2019/0365066 | A1 | 12/2019 | Hill |
| 2020/0077758 | A1 | 3/2020 | Hoffman |
| 2020/0229557 | A1 | 7/2020 | Tran |
| 2020/0305564 | A1 | 10/2020 | Myers |
| 2020/0379509 | A1 | 12/2020 | Coward |
| 2021/0112935 | A1 | 4/2021 | Tran |
| 2021/0330045 | A1 | 10/2021 | Tran |
| 2021/0337945 | A1 | 11/2021 | Popoff |

OTHER PUBLICATIONS

Onward Innovation—"RFID Carbon Fiber Cash Strap Wallet"—Downloaded Apr. 9, 2021—Available from Internet <URL: https://onwardinnovation.com/products/rfid-carbon-fiber-cash-strap-wallet?Variant=31920056205360&currency=USD>.

Ridge—"Aluminum—Black"—Downloaded Apr. 9, 2021—Available from Internet <URL: https://ridge.com/products/aluminum-black?>.

Titan X—"Titan X | Pro Edition"—Downloaded Apr. 9, 2021—Available from Internet <URL: https://titanxwallet.com/products/edition?currency=USD&variant=33003264409643>.

Alpine Swiss—"Alpine Swiss Genuine Leather Super Thing Slim Cash Strap Front Pocket Wallet"—Downloaded Apr. 9, 2021—Available from Internet <URL: https://www.alpineswiss.com/alpine-swiss-genuine-leather-super-thin-slim-cash-strap-front-pocket-wallet/>.

Simple Zone—"Carbon Fiber Wallet for Men, Simple Zone RFID Blocking Slim Minimalist Card Holder Wallet with Money Clip and Cash Strap"—First available Jun. 18, 2020—Downloaded Apr. 9, 2021—Available from Internet <URL: https://www.amazon.com/Carbon-Simple-Zone-Blocking-Minimalist/dp/B08BG4G8GJ>.

Dango Products—"T01 Tactical Bifold Wallet—Spec-Ops—Blueline"—Downloaded Apr. 9, 2021—Available from Internet <URL: https://www.dangoproducts.com/products/t01-tactical-bifold-wallet-blueline-spec-ops? variant=21433891881044>.

Dango Products—"Dango M1 Maverick Wallet—CNC—Machined Aluminum, RFID Blocking, Made in USA"—First available Jan. 12, 2019—Downloaded May 24, 2021—Available from Internet <URL: https://www.amazon.com/dp/807MMDRGCV/ref=as_li_ss_tl?ie-UTF8&linkCode-sl1&tag=k1a209-20&linkId-8c261f44b8217cb2913188b624fa5e66&language-en_US>.

Dango Products—"Dango Products—M1 Maverick Bifold Wallet"—Video by user Dango Products—First available Nov. 29, 2018—Downloaded May 24, 2021—Available from Internet <URL: https://www.youtube.com/watch?v=kqF_xCWWLOU>.

Muradin—"Muradin Dapper Leather Bifold Wallet—Genuine Tactical Wallet—Card Wallet for Men—RFID-Blocking Aluminum Metal Wallet"—First available Nov. 22, 2020—Downloaded May 24, 2021—Available from Internet <URL: https://www.amazon.com/MURADIN-Dapper-Leather-Bifold-Wallet/dp/B07ZPXH81N?th=1 >.

Dango Products—"A10 Adapt Wallet"—Downloaded May 25, 2021—Available from Internet <URL: https://www.dangoproducts.com/collections/a-series-wallets/products/a10-adapt-wallet>.

Hanker—"Carbon Fiber Aluminum Metal Minimalist Wallet RFID Blocking Credit Card Holder Money Clip"—First available Feb. 7, 2019—Downloaded May 25, 20219—Available from Internet <URL: https://www.amazon.com/Carbon-Aluminum-Minimalist-Wallet-Blocking/dp/B07NHK6P55>.

Elephant Wallet—"N Wallet Carbon Fiber—Fabric Rubber"—Downloaded Mar. 17, 2021—Available from Internet <URL: https://elephantwallet.com/products/n-wallet-carbon-fiber>.

Elephant Wallet—"How Does It Work (X Wallet)"—Downloaded Mar. 17, 2021—Available from Internet <URL: https://elephantwallet.com/pages/how-does-it-work>.

Wallet Gear—"Bifold Leather Wallet with Elastic Band"—Downloaded Mar. 17, 2021—Available from Internet <URL: https://www.walletgear.com/bifold-leather-wallet-with-elastic-band.html>.

Curated Basics—"Elastic Band Minimalist Wallet"—Downloaded Mar. 17, 2021—Available from Internet <URL: https://www.curatedbasics.com/products/elastic-band>.

Dango Products—"Dango D03 Dapper Bifold EDC Wallet—Made in USA—Genuine Leather, Slim, Minimalist, Metal, RFID Blocking"—Downloaded Nov. 24, 2021—Available at least as of Apr. 22, 2021 (first review)—Available from Internet <URL: https://www.amazon.com/Dango-D03-Dapper-Bifold-Wallet/dp/B0925CV8CK?ref_=ast_sto_dp&th=1>.

Dango Products—"D03 Dapper Bifold Wallet"—Downloaded Nov. 24, 2021—Available from Internet <URL: https://www.dangoproducts.com/products/d03-dapper-wallet?_pos=6&_sid=87be8627b&_ss=r>.

Dango Products—"Dango Products: D03 Dapper Bifold Wallet"—Video by user Dango Products—First available Apr. 20, 2021—Downloaded Nov. 24, 2021—Available from Internet <URL: https://www.youtube.com/watch?v=QSLs3ABQcoY>.

Dango Products—"A10 Bifold Pen Adapter"—Video by user Dango Products—First available Jul. 15, 2020—Downloaded Nov. 24, 2021—Available from Internet <URL: https://www.youtube.com/watch?v=7y6fXT8Y0SI>.

Dango Products—"A10 Adapt Bifold Pen Wallet"—Available from Internet <URL: https://www.dangoproducts.com/products/a10-adapt-bifold-pen-wallet?_pos=6&_sid=5cec358d2&_ss=r>.

Dango Products—"Dango M1 Maverick Rail EDC Wallet—Made in USA—All-Metal, Minimalist, Slim, RFID Blocking"—First Available Oct. 9, 2019—Downloaded Nov. 24, 2021—Available from Internet <URL: https://www.amazon.com/Dango-M1-Maverick-Rail-Wallet/dp/B07YWJWK9Z>.

Dango Products—"Dango M1 Maverick Rail Wallet"—First Available Oct. 7, 2019—Downloaded Nov. 24, 2021—Available from Internet <URL: https://www.youtube.com/watch?v=5xTPdgAZkL8>.

Dango Products—"M1 Maverick Rail Wallet"—Downloaded Nov. 24, 2021—Available from Internet <URL: https://www.dangoproducts.com/products/m1-maverick-rail-wallet.

Anvi Original—"MiniCap 1.0/2.0 Mens RFID Blocking Front Pocket Minimalist Slim Wallet With Pull Tab Money Slip"—First available Sep. 14, 2018—Downloaded Nov. 11, 2021—Available from Internet <URL: https://vww.amazon.com/Minicap1-0-Blocking-Pocket-Minimalist-Wallet/dp/B07HCD1BRR.

Leatheram—"Handmade pull up card holder, leather credit card case with pull tab, minimalist wallet, thin minimal wallet"—Available at least as of Dec. 14, 2019—Downloaded Nov. 11, 2021—Available from Internet <URL: https://www.etsy.com/listing/235786494/handmade-pull-up-card-holder-leather?gpla=1&gao=1&.

Nite Ize—"Nite Ize Financial Tool, Multi Tool Money Clip, Minimalist Wallet, Money Clip, Multi Tool, and Credit Card Holder Combo, Stainless Steel"—First available Mar. 1, 2018—Downloaded Jul. 29, 2021—Available from Internet <URL: https://www.amazon.com/gp/product/B078KZSGKR/ref=as_li_tl?ie=UTF8&camp=1789&creative=9325&creativeASIN=B078KZSGKR&linkCode=as2&tag=gearmoose-20&linkId=ea188cd142e324326581d5cf27a7eb60>.

Safe Price—"Stainless Steel Men Money Clip Elastic Band Slim Credit Card Holder Wallet Purse (Silver)"—First available Sep. 20, 2017—Downloaded Jul. 29, 2021—Available from Internet <URL: https://www.amazon.com/Stainless-Elastic-Credit-Holder-Wallet/dp/B075S95PQ7?th=1>.

TI-EDC—"TI-EDC Titanium Slim Cash Money Clip Wallet Credit Card Holder and Bottle Opener"—First Available Dec. 10, 2013—Downloaded Jul. 29, 2021—Available from Internet <URL: https://www.amazon.com/TI-EDC-Titanium-Wallet-Credit-Holder/dp/B00H7UHZZY/ref=asc_df_B00H7UHZZY/?tag=hyprod-20&linkCode=df0&hvadid=167122580135&hvpos=&hvnetw=g&hvrand=3990154944988812308&hvpone=&hvptwo=&hvqmt=&hvdev=c&hvdvcmdl=&hvlocint=&hvlocphy=9019667&hvtargid=pla-311720176311 &psc=1 >.

(56) References Cited

OTHER PUBLICATIONS

Cheers All—"Beer Opener Money Clip"—Downloaded Jul. 29, 2021—Available from Internet <URL: https://cheersall.com/products/beer-opener-money-clip?variant=14100368031805&currency=USD&utm_medium=product_sync&utm_source=google&utm_content=sag_organic&utm_campaign=sag_organic&gclid=CjwKCAjwuvmHBhAxEiwAWAYj-I6xbGH0L1OthGghbE0Q4wTje17ifU45SOT7qX9YbVV-fwCDBFz2tRoC_w0QAvD_BwE>.
Nomatic—Wallet—Downloaded Nov. 11, 2021 from https://www.nomatic.com/products/wallet?variant=29792289849416&currency=USD&utm_medium=product_sync&utm_source=google&utm_content=sag_organic&utm_campaign=sag_organic.
Distil—Wally Bifold Classic—Downloaded Nov. 11, 2021 from https://distilunion.com/products/wally-bifold-classic?currency=USD&variant=39371173199935.
Dango Products—"M1 Maverick Bifold Wallet Spec-Ops Edition"—First Available Nov. 29, 2018—Downloaded Nov. 23, 2021—Available from Internet <URL: https://www.youtube.com/watch?v=KSFzWMDOTAc>.
Dango Products—"MT01 Clasp Multi-Tool"—First Available Mar. 19, 2019—Downloaded Nov. 23, 2021—Available from Internet <URL: https://www.youtube.com/watch?v=7SVGTLoDUsE>.

* cited by examiner

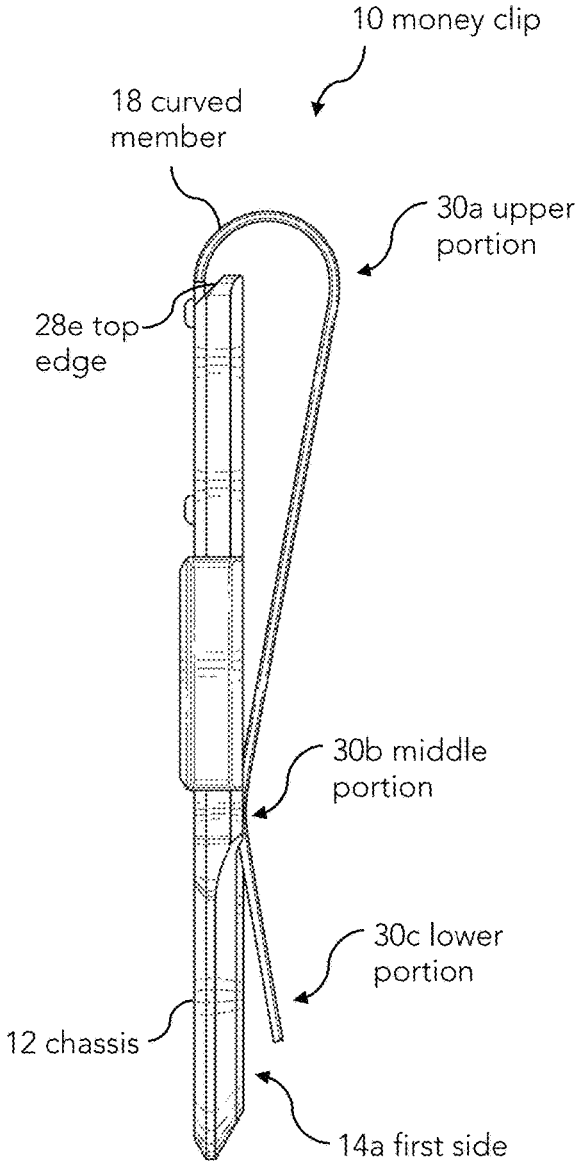
Figure 10A
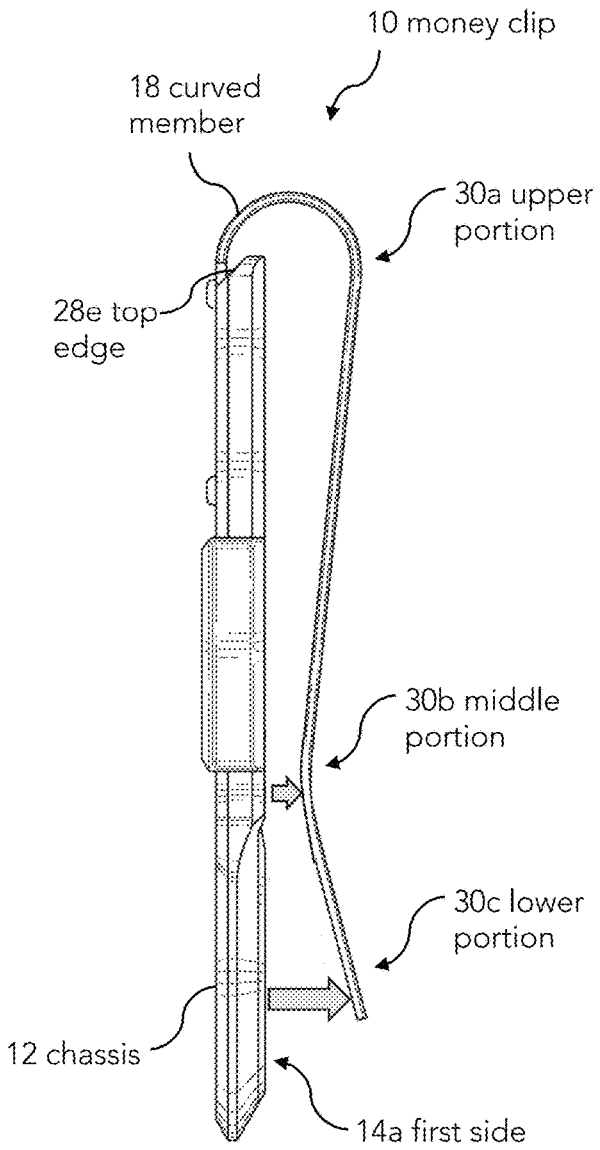
Figure 10B
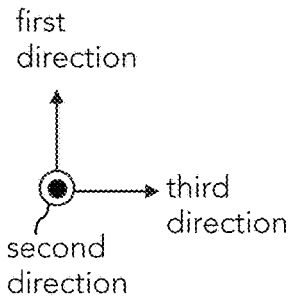

MONEY CLIP

BACKGROUND

Field

Various embodiments disclosed herein generally relate to money clips. More specifically, the present disclosure relates to money clips with a dual piece metal construction and a stretchable band.

Description of Related Art

Money clips are designed to carry articles such as credit cards, currency, business cards, pictures, identification cards (such as a driver's license or work ID), plus assorted other paper items. The most common type of money clip is constructed of a single piece of bended metal, where paper currency, cards, etc. are held between the two sections of the metal piece. Traditional money clips commonly fail to retain a degree of flexibility, so that after a period of holding a large quantity of cards and/or currency they become "loose" and can no longer securely hold a smaller quantity of cards and/or currency, leaving the cards and/or currency vulnerable to being lost. In addition, traditional money clips may be unorganized, as they don't allow for separation of currency from cards and/or separation of large bills from small bills. There is therefore a need for an improved type of money clip to hold a high capacity of cards and currency while maintaining a degree of flexibility and allowing for greater organization of the cards and currency.

SUMMARY

The disclosure includes a money clip comprising a chassis defining a first side, a second side located opposite the first side, a top portion, and a bottom portion located opposite the top portion, a curved member mechanically coupled to the second side of the chassis adjacent the top portion, the curved member configured to curve around the top portion to the first side of the chassis, the curved member terminating adjacent the bottom portion, and a stretchable band configured to wrap around the chassis, a first portion of the stretchable band located between the first side of the chassis and the curved member and a second portion of the stretchable band located on the second side of the chassis. In some embodiments, the stretchable band is configured to receive and retain at least one of at least one personal card and at least one paper bill to the chassis. The stretchable band may be configured to provide friction between the curved member and the first side of the chassis to enable the money clip to retain the at least one of at least one personal card and at least one paper bill between the curved member and the first side of the chassis.

The chassis may define a first edge and a second edge located opposite the first edge, each of the first edge and the second edge configured to extend between the top portion and the bottom portion. The stretchable band may be configured to wrap around the chassis such that it contacts at least one of the first side, the second side, the first edge, and the second edge. In some embodiments, the first edge defines a length less than a second edge, and the chassis further defines a third edge configured to extend from a bottom portion of the first edge to a bottom edge of the chassis.

The chassis may extend along a first direction and the stretchable band may wrap around the chassis along a second direction perpendicular to the first direction. In some embodiments, at least a portion of the curved member is offset from the chassis along a third direction that is perpendicular to the first direction and the second direction. The curved member may comprise an upper portion, a middle portion, and a lower portion, wherein the upper portion may be physically spaced from the chassis by a first length, the lower portion may be physically spaced from the chassis by a second length, and the middle portion may be physically spaced from the chassis by a third length that is less than the first length and the second length. In some embodiments, the middle portion is configured to contact the first side of the chassis. The second length may be less than the first length.

In some embodiments, the upper portion of the curved member is physically spaced along the first direction from a top edge of the chassis and along the third direction from the first side of the chassis. The lower portion of the curved member may be physically spaced along the third direction from the first side of the chassis, and the middle portion may be configured to move along the third direction to receive at least one of at least one personal card and at least one paper bill, thereby retaining the at least one of at least one personal card and at least one paper bill between the curved member and the first side of the chassis.

The money clip may further comprise a first aperture located on the curved member adjacent the top portion of the chassis and a second aperture located on the chassis adjacent the bottom portion. In some embodiments, the first aperture and the second aperture are configured to receive at least one attaching member, wherein the at least one attaching member comprises at least one of a keyring, a lanyard, a clip, and a tether. The money clip may also further comprise a bottle opener located on the curved member adjacent the top portion of the chassis, the bottle opener defining an angled aperture configured to receive at least a portion of a bottle cap.

In some embodiments, the money clip further comprises a first set of at least one aperture located on the chassis, a second set of at least one aperture located on a front face of the curved member, and a third set of at least one aperture located on a back face of the curved member. The front face may be located adjacent the first side of the chassis and the back face may be coupled to the second side of the chassis. In some embodiments, the first set of at least one aperture is substantially aligned with the third set of at least one aperture. The at least one aperture of at least one of the first set, the second set, and the third set may be configured to allow a user to view at least one of at least one personal card and at least one paper bill coupled to the money clip.

In some embodiments, the chassis defines a first edge and a second edge located opposite the first edge, wherein each of the first edge and the second edge is configured to extend along a first direction between the top portion and the bottom portion. The chassis may further define a third edge configured to extend along a first angled direction that is not perpendicular to the first direction. In some embodiments, the stretchable band is configured to wrap around the chassis along a second direction perpendicular to the first direction. The first set of at least one aperture and the third set of at least one aperture may be configured to extend along the second direction. The second set of at least one aperture may be configured to extend along a second angled direction that is perpendicular to the first angled direction.

The chassis may further define a top edge extending along the second direction between the first edge and the second edge, and a bottom edge extending along the second direction between the third edge and the second edge. At least a portion of at least one of the first edge, the second edge, the third edge, the top edge, and the bottom edge may comprise a beveled edge. In some embodiments, the bottom edge comprises a bottom aperture defining a first side located adjacent the first side of the chassis and a second side located adjacent the second side of the chassis, wherein the first side of the bottom aperture does not comprise the beveled edge and the second side of the bottom aperture comprises the beveled edge. The bottom aperture may extend along the second direction.

In some embodiments, the chassis comprises aluminum, the curved member comprises a titanium alloy, and the stretchable band comprises silicone.

A first edge and a second edge of the chassis may extend along a first direction, the stretchable band may wrap around the chassis along a second direction perpendicular to the first direction, and a third edge of the chassis may extend along a first diagonal direction that is not perpendicular to the first direction or the second direction. In some embodiments, the curved member comprises an upper portion, a middle portion, and a lower portion, wherein the upper portion and the lower portion are configured to be physically spaced from the first side of the chassis along a third direction that is perpendicular to the first direction and the second direction. The upper portion may comprise a bottle opener. In some embodiments, the stretchable band is configured to receive and retain at least one of at least one personal card and at least one paper bill. The stretchable band may be configured to provide friction between the curved member and the first side of the chassis to enable the money clip to retain the at least one of at least one personal card and at least one paper bill between the curved member and the first side of the chassis.

In some embodiments, the money clip further comprises a first set of at least one aperture located on the chassis, a second set of at least one aperture located on a front face of the curved member, and a third set of at least one aperture located on a back face of the curved member. The front face may be located adjacent the first side of the chassis and the back face may be coupled to the second side of the chassis. In some embodiments, the first set comprises at least one aperture located on a bottom portion of the chassis and at least one aperture located on a top portion of the chassis, each aperture of the first set extending along the second direction. The second set may comprise at least one aperture extending along a second angled direction perpendicular to the first angled direction. The third set may comprise at least one aperture extending along the second direction.

In some embodiments, the first set comprises a first aperture located on the bottom portion. The first aperture may define a first length. The first set may also comprise a second aperture located on the bottom portion, and the second aperture may define a second length. In some embodiments, the first set comprises a third aperture located on the bottom portion, and the third aperture defines a third length. The third length may be less than the first length and the second length, and the second length may be less than the first length. In some embodiments, the first set further comprises a fourth aperture located on the top portion, and the fourth aperture defines a fourth length. The first set may comprise a fifth aperture located on the top portion, and the fifth aperture may define a fifth length. In some embodiments, the fourth length and the fifth length are substantially equal to the first length.

The second set may comprise two apertures extending along the second angled direction. In some embodiments, the third set comprises two apertures extending along the second direction, wherein each of the two apertures is substantially aligned with the fourth aperture and the fifth aperture.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

FIGS. 9, 10A, and 10B illustrate side views of a money clip, according to some embodiments.

DETAILED DESCRIPTION

Figure 1:
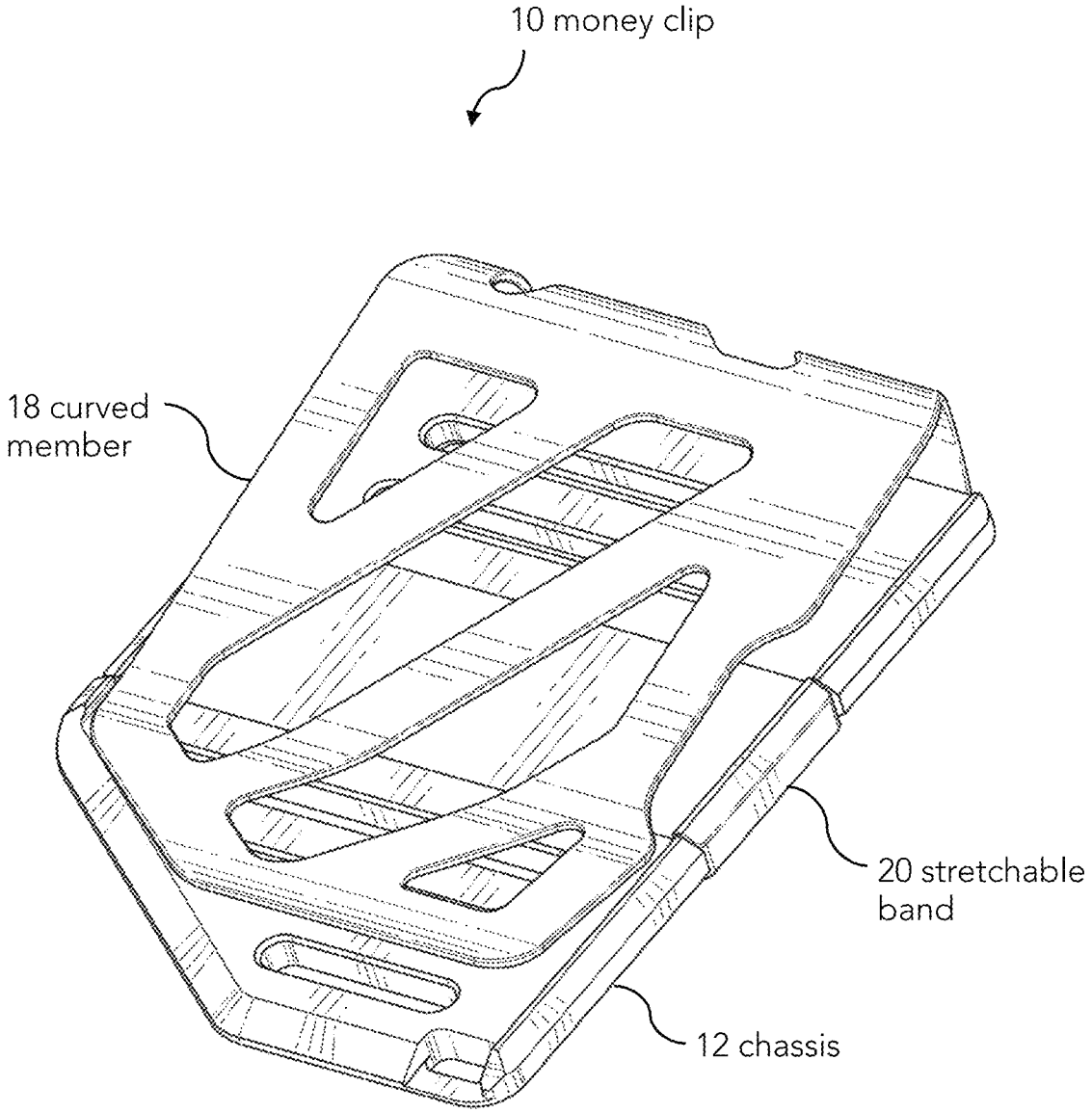
FIG. 1 illustrates a front perspective view of a money clip, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

REFERENCE NUMERALS

10—money clip
12—chassis
14*a*—first side (of chassis)
14*b*—second side (of chassis)
16*a*—top portion (of chassis)
16*b*—bottom portion (of chassis)
18—curved member

20—stretchable band
22*a*—first portion (of stretchable band)
22*b*—second portion (of stretchable band)
24—at least one personal card
26—at least one paper bill
28*a*—first edge (of chassis)
28*b*—second edge (of chassis)
28*c*—third edge (of chassis)
28*d*—bottom edge (of chassis)
28*e*—top edge (of chassis)
30*a*—upper portion (of curved member)
30*b*—middle portion (of curved member)
30*c*—lower portion (of curved member)
32*a*—first length
32*b*—second length
34*a*—first aperture
34*b*—second aperture
36—bottle opener
38—angled aperture
40*a*—first set of at least one aperture
40*b*—second set of at least one aperture
40*c*—third set of at least one aperture
42*a*—front face (of curved member)
42*b*—back face (of curved member)
44—at least one attaching mechanism

INTRODUCTION

The disclosure includes multiple embodiments of a money clip. In some embodiments, the money clip comprises a dual-piece construction with a stretchable band configured to wrap around a chassis of the money clip. The money clip may be configured to hold multiple personal cards, such as credit cards, identification cards, business cards, membership cards (e.g., grocery store rewards card, gym membership, library card), gift cards, and the like. Multiple embodiments may also be configured to hold paper currency, coupons, photographs, and other paper items.

FIG. 1 illustrates a front perspective view of a money clip 10. In some embodiments, as shown in FIG. 1, the money clip 10 comprises a chassis 12, a curved member 18, and a stretchable band 20. The stretchable band 20 may be configured to wrap around the chassis 12. As mentioned previously in this disclosure, traditional money clips are often comprised of a single piece of bended metal. This single piece of bended metal may fail to retain its shape over time, resulting in a loose money clip that cannot securely hold personal cards and/or paper currency. In addition, traditional money clips usually only have one usable side, like the side shown in FIG. 2 where the money clip 10 is configured to receive and retain at least one personal card and/or at least one paper bill between the curved member 18 and the chassis 12.

Figure 2:
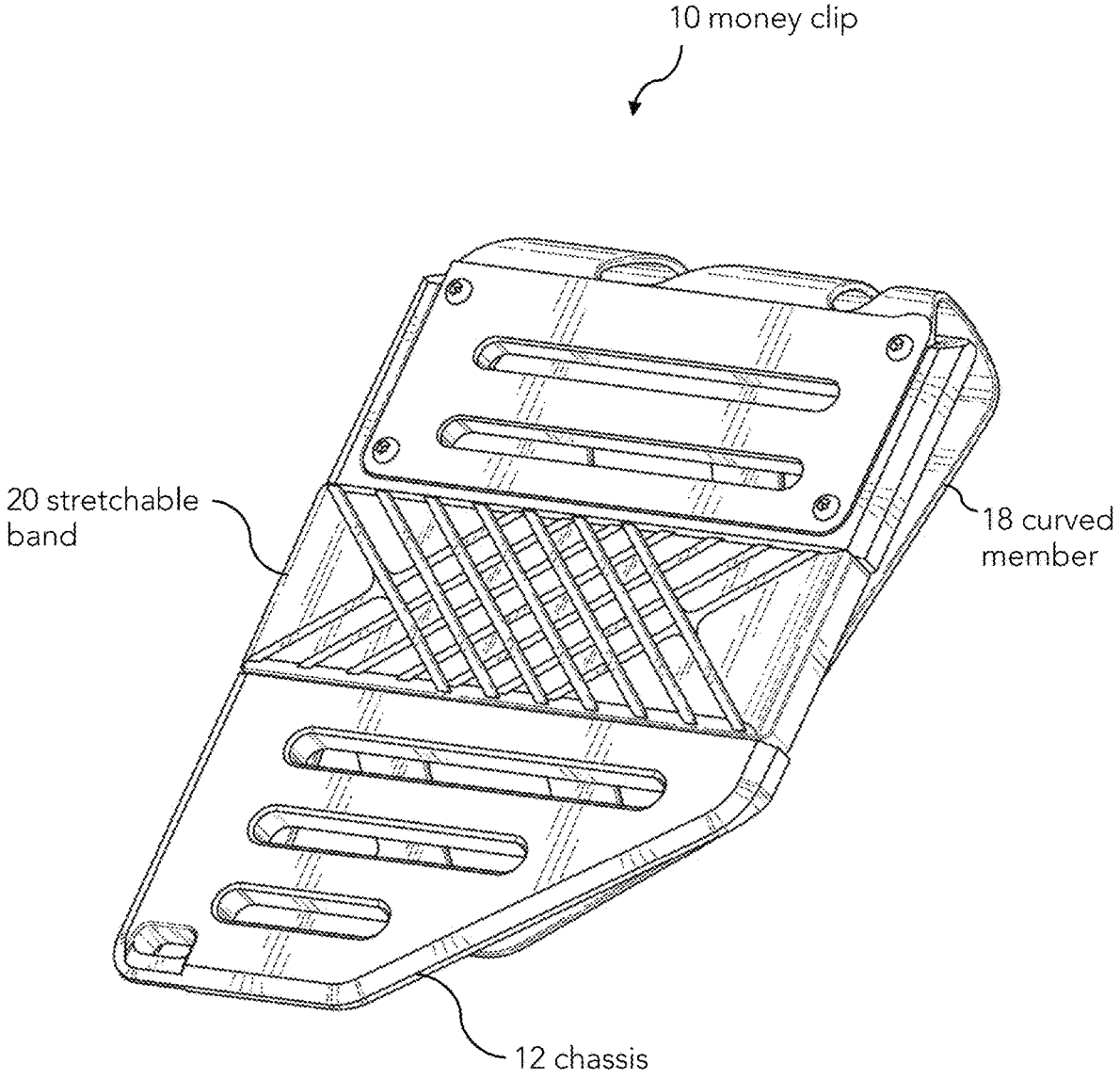
FIG. 2 illustrates a back perspective view of a money clip, according to some embodiments.
Figure 7:
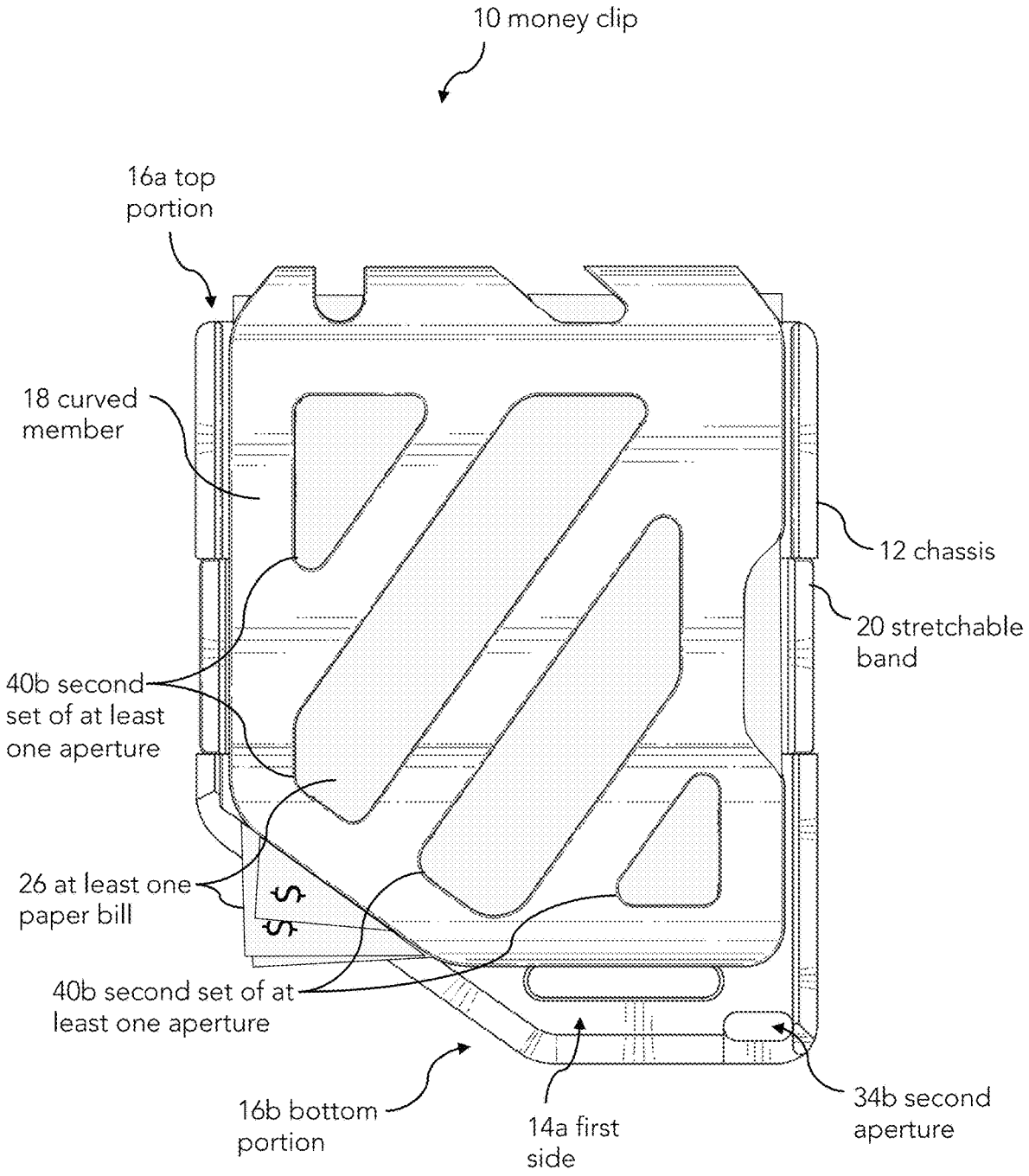
FIG. 7 illustrates a front view of a money clip coupled to at least one paper bill, according to some embodiments.
Figure 8:
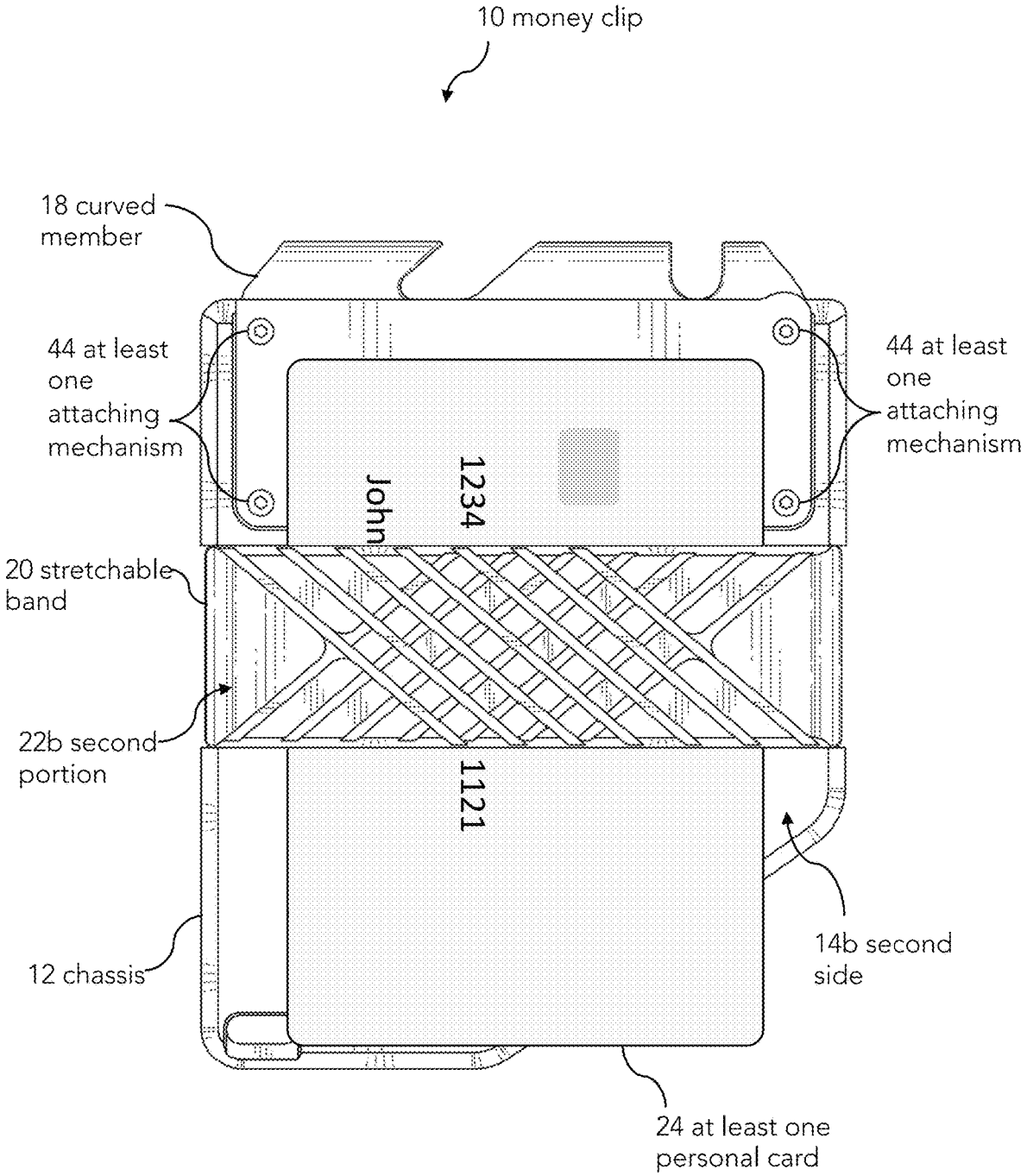
FIG. 8 illustrates a back view of a money clip coupled to at least one personal card, according to some embodiments.

In contrast, as illustrated in FIG. 2, the money clip 10 comprises two separate components—the chassis 12 and the curved member 18. In some embodiments, as illustrated in the back perspective view of FIG. 2, the curved member 18 is coupled to a back portion of the chassis 12. Also shown in FIG. 2 is the stretchable band 20. The inclusion of the stretchable band 20 may enable a user of the money clip 10 to store at least one personal card and/or at least one paper bill on both sides of the money clip 10. For example, in some embodiments, the stretchable band 20 is configured to receive and retain at least one personal card and/or at least one paper bill between the stretchable band 20 and the chassis 12. On the other side of the chassis 12, the curved member 18 may be configured to also receive and retain at least one personal card and/or at least one paper bill between the curved member 18 and the chassis 12. FIGS. 7 and 8 illustrate the money clip 10 holding at least one paper bill 26 (FIG. 7) and at least one personal card 24 (FIG. 8), and will be discussed in greater detail later in the disclosure.

As previously discussed, the money clip 10 comprises a dual-piece construction, including the chassis 12 and the curved member 18. The chassis 12 and the curved member 18 may comprise metal components. In some embodiments, the chassis 12 comprises aluminum and the curved member 18 comprises a titanium alloy. At least one of the chassis 12 and the curved member 18 may comprise different materials than aluminum and titanium. The curved member 18 may comprise any material that is strong and also bendable, such that it is configured to retain a bended shape without stressing and/or cracking over time. The money clip 10 may be thought of as comprising a tri-piece construction, including the chassis 12, the curved member 18, and the stretchable band 20. The stretchable band 20 may comprise silicone. The stretchable band 20 may comprise another flexible, stretchable material, such as elastic, rubber, or a similar material.

In some embodiments, the combination of different materials comprising the money clip 10 provides friction (or "grip") that facilitates more secure retention of at least one personal card and/or at least one paper bill. For example, the material of the stretchable band 20 may provide friction between the curved member 18 and the chassis 12 to enable the money clip 10 to retain at least one personal card and/or at least one paper bill between the curved member 18 and the chassis 12. In some embodiments, without the stretchable band 20, the money clip 10 comprises only metal elements and there is little to no friction between the chassis 12 and the curved member 18. In such an embodiment, the money clip 10 relies purely on the strength of the curved member 18 bending toward the chassis 12 (i.e., "squeezing" strength between the curved member 18 and the chassis 12) to hold at least one personal card and/or at least one paper bill between the chassis 12 and the curved member 18. The addition of the stretchable band 20 introduces a different material, and greater friction, between the chassis 12 and the curved member 18, and provides something for the at least one personal card and/or at least one paper bill to "grip" onto, in addition to the "squeezing" strength between the curved member 18 and the chassis 12.

Figure 3:
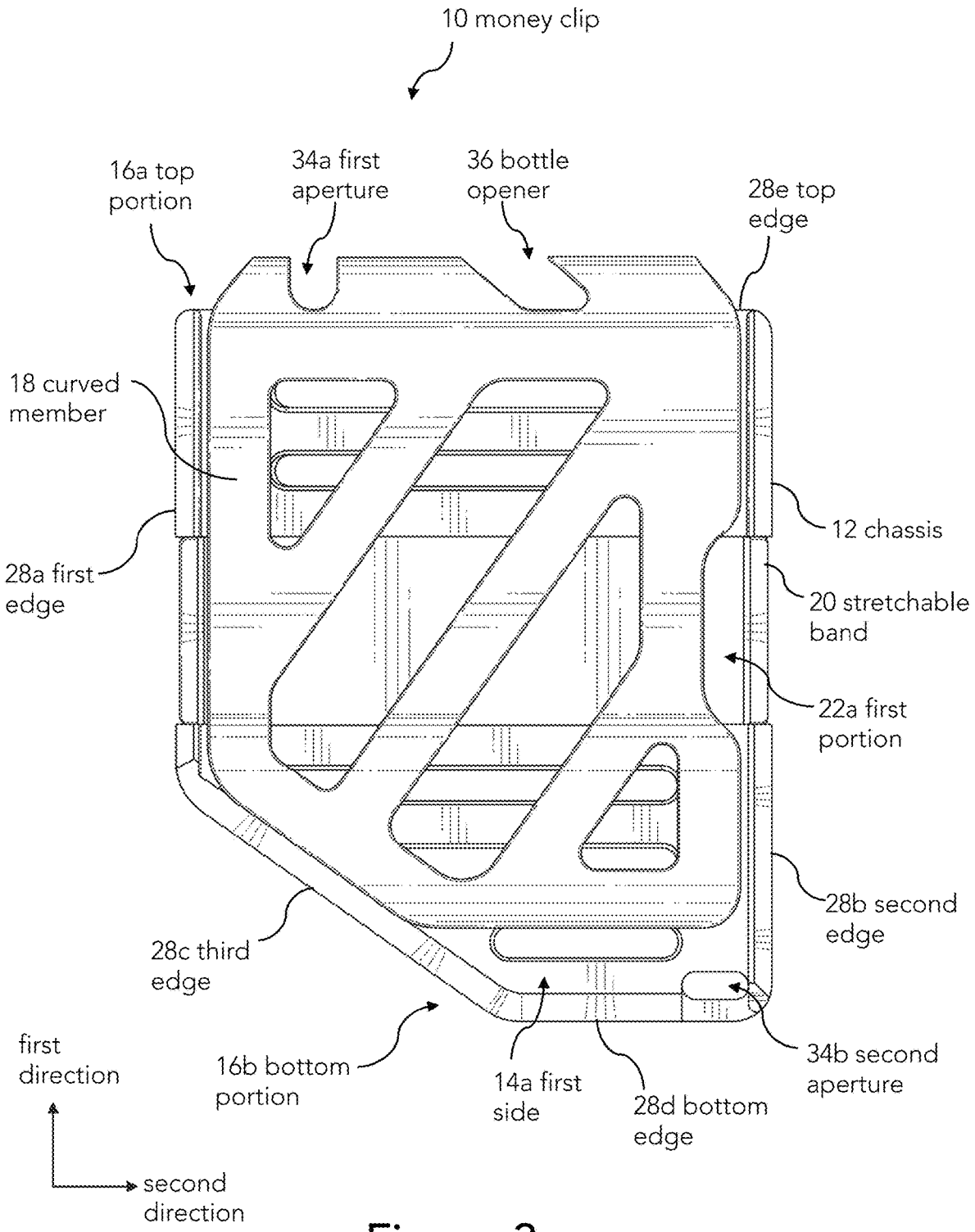
FIG. 3 illustrates a front view of a money clip, according to some embodiments.
Figure 4:
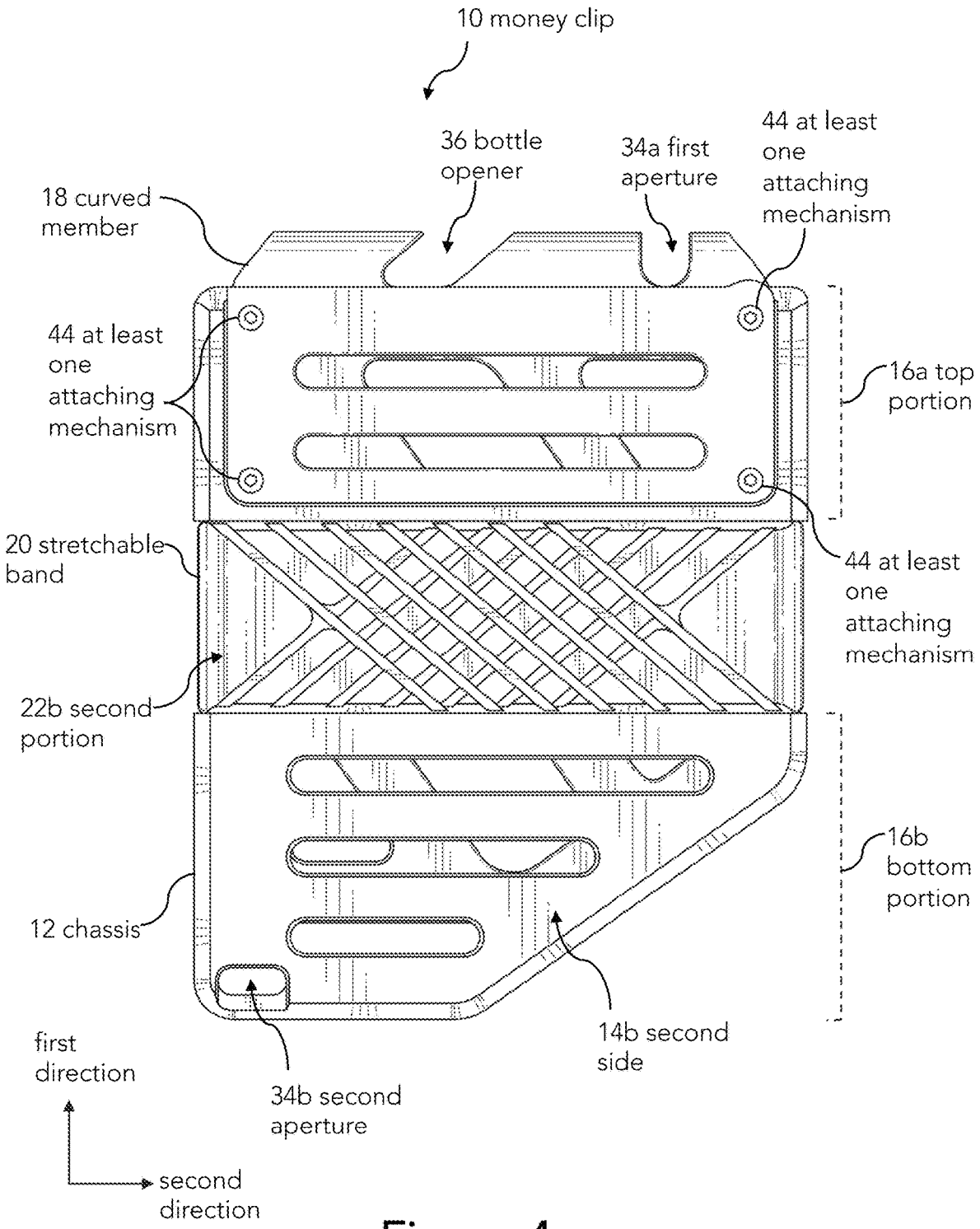
FIGS. 4 and 5 illustrate back views of a money clip, according to some embodiments.
Figure 5:
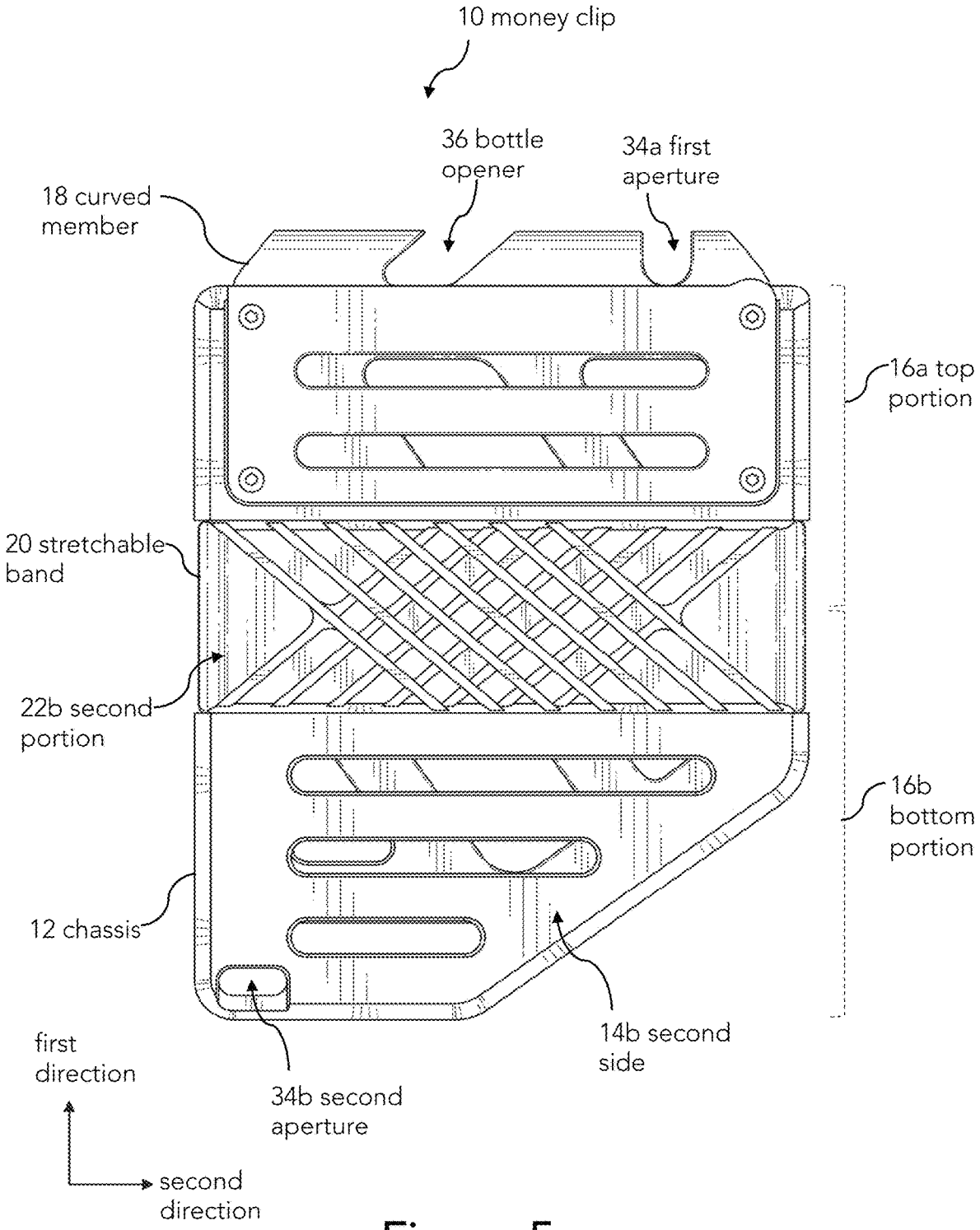

Turning now to FIG. 3, a front view of the money clip 10 is shown. In some embodiments, the chassis 12 defines a first side 14*a*, as shown in FIG. 3, and a second side 14*b* located opposite the first side 14*a*, which is shown in FIGS. 4 and 5. The chassis 12 may also define a top portion 16*a* and a bottom portion 16*b* located opposite the top portion 16*a*. The top and bottom portions 16*a*, 16*b* will be discussed in greater detail with reference to FIGS. 4 and 5. In some embodiments, the stretchable band 20 is configured to wrap around the chassis 12. The stretchable band 20 may comprise a first portion 22*a* located between the first side 14*a* of the chassis 12 and the curved member 18. As shown in FIGS. 4 and 5, the stretchable band 20 may also comprise a second portion 22*b* located on the second side 14*b* of the chassis 12.

FIG. 3 also illustrates that, in some embodiments, the chassis 12 defines a first edge 28*a* and a second edge 28*b* located opposite the first edge 28*a*. Each of the first edge 28*a* and the second edge 28*b* may be configured to extend between the top portion 16*a* and the bottom portion 16*b*. In some embodiments, the stretchable band 20 is configured to wrap around the chassis 12 such that it contacts at least one of the first side 14*a*, the second side 14*b*, the first edge 28*a*, and the second edge 28*b*. The chassis 12 may further define a third edge 28*c* configured to extend from a bottom portion of the first edge 28*a* to a bottom edge 28*d* of the chassis 12, as demonstrated in FIG. 3. As also demonstrated in FIG. 3, the first edge 28*a* may define a length less than the second edge 28*b*. In some embodiments, the chassis 12 also includes a top edge 28*e* located opposite the bottom edge 28*d*, wherein the top edge 28*e* is configured to extend between the first edge 28*a* and the second edge 28*b*, and the bottom edge 28*d* is configured to extend between the third edge 28*c* and the second edge 28*b*.

At least one of the first edge 28*a*, the second edge 28*b*, the third edge 28*c*, the bottom edge 28*d*, and the top edge 28*e* may define a beveled edge. In some embodiments, a beveled edge(s) not only elevates the aesthetic appearance of the money clip 10, but also allows the money clip 10 to be stored more easily. For example, if a user is trying to fit the money clip 10 into a tight pocket, like a clothing pocket, bag pocket, or the like, the beveled edge(s) may help facilitate easier movement of the money clip 10 than would be possible with blunt edge(s). The money clip 10 comprising beveled edge(s) on the chassis 12 may also be more comfortable to hold than a money clip comprising blunt edge(s) on a chassis.

As suggested by the directional indicator in FIG. 3, in some embodiments the first edge 28*a* and the second edge 28*b* are configured to extend along a first direction, while the bottom edge 28*d* and the top edge 28*e* are configured to extend along a second direction perpendicular to the first direction. The stretchable band 20 may also be configured to extend along the second direction. The direction of the third edge 28*c* will be discussed with reference to FIG. 6.

FIGS. 3-5 show that the money clip 10 may include a first aperture 34*a* located on the curved member 18 adjacent the top portion 16*a* of the chassis 12. The money clip 10 may also include a second aperture 34*b* located on the chassis 12 adjacent the bottom portion 16*b*. The second aperture 34*b* may also be referred to as a bottom aperture. In some embodiments, the first aperture 34*a* and the second aperture 34*b* are configured to receive at least one attaching member. The attaching member may comprise at least one of a keyring, a lanyard, a clip, a tether, or other similar mechanism. For example, a user may desire to attach a set of keys to the first aperture 34*a* and a carabiner (or other clip-type mechanism) to the second aperture 34*b*, in order to couple the money clip 10 to a belt loop, a bag handle, etc. The second aperture 34*b* may be configured to extend along the second direction, like the stretchable band 20, top edge 28*e*, and bottom edge 28*d*.

The second aperture 34*b* may define a first side located adjacent the first side 14*a* of the chassis 12 and a second side located adjacent the second side 14*b* of the chassis 12. As such, the first side of the second aperture 34*b* may be visible in FIG. 3, while the second side of the second aperture 34*b* may be visible in FIGS. 4 and 5. In some embodiments, the second side of the second aperture 34*b* comprises a beveled edge similar to the beveled edges discussed above. In contrast, the first side of the second aperture 34*b* may not comprise a beveled edge. In some embodiments, the difference in sides of the second aperture 34*b* is a result of the machining process of the chassis 12. The difference in sides may also make it easier for a user to couple a keyring, or other similar type of mechanism, to the second aperture 34*b*. For example, if both sides of the second aperture 34*b* comprised beveled edges, the second aperture 34*b* would have a thicker bottom portion and it would likely be more difficult to attach a keyring (or similar mechanism) to the second aperture 34*b*. The non-beveled first side of the second aperture 34*b* may provide a blunt edge to use as leverage to open a keyring, where the beveled second side may not assist a user in opening a keyring, as the beveled second side may slope downward and make it more difficult to open the keyring (or similar mechanism).

FIGS. 3-5 also illustrate that, in some embodiments, the money clip 10 comprises a bottle opener 36 located on the curved member 18 adjacent the top portion 16*a* of the chassis 12. The bottle opener 36 may be located adjacent the first aperture 34*a*, as illustrated in the Figures. In some embodiments, the bottle opener 36 defines an angled aperture configured to receive at least a portion of a bottle cap. The bottle opener 36 and the first aperture 34*a* are shown in greater detail in FIG. 11, and will be discussed further with reference therein.

FIGS. 4 and 5 illustrate back views of the money clip 10, including the second side 14*b* of the chassis 12. In some embodiments, as illustrated in FIGS. 4 and 5, the curved member 18 is mechanically coupled to the second side 14*b* of the chassis 12 adjacent the top portion 16*a* of the chassis 12. The curved member 18 may be mechanically coupled via at least one attaching mechanism 44, as indicated in FIG. 4. In some embodiments, the at least one attaching mechanism 44 comprises at least one screw, bolt, or similar attaching mechanism. The at least one attaching mechanism 44 may comprise four total attaching mechanisms. In some embodiments, each of the at least one attaching mechanism 44 comprises a stainless steel bolt. The at least one attaching mechanism 44 may comprise a different type of metal, or a non-metallic material of sufficient strength and durability to couple the curved member 18 to the chassis 12.

Figure 9:
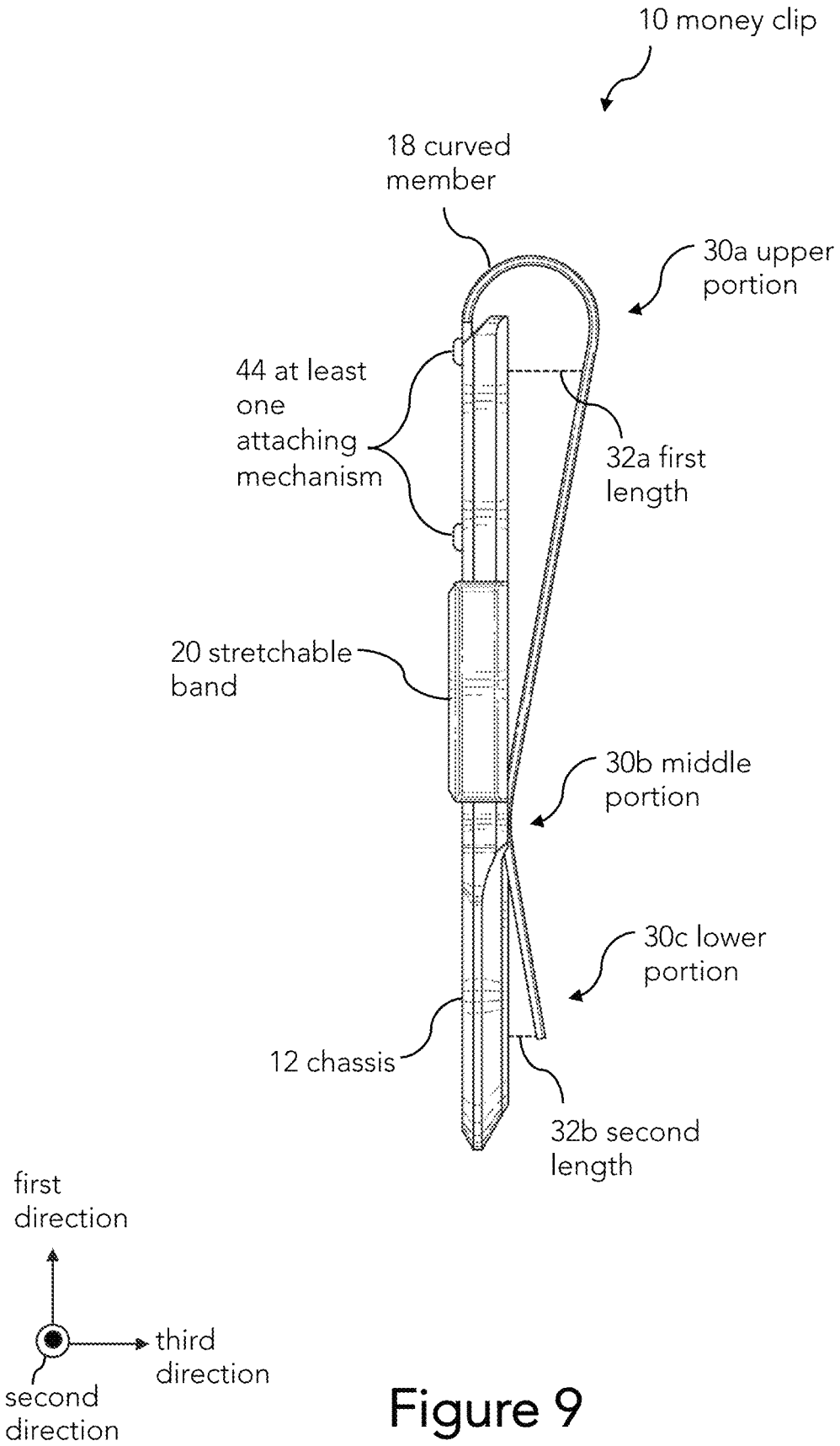

The curved member 18 may be configured to curve around the top portion 16*a* to the first side 14*a* of the chassis 12 and terminate adjacent the bottom portion 16*b*, as illustrated in FIGS. 9, 10A, and 10B. It should be noted that the "top portion 16*a*" and the "bottom portion 16*b*" may be defined broadly, in terms of how much of the chassis 12 defines either the top portion 16*a* or the bottom portion 16*b*. For example, as shown in FIG. 4, the top portion 16*a* may comprise a portion of the chassis 12 located above the stretchable band 20, while the bottom portion 16*b* may comprise a portion of the chassis 12 located below the stretchable band 20. As shown in FIG. 5, the top portion 16*a* may comprise about half of an area of the chassis 12 covered by the stretchable band 20, as well as the portion of the chassis 12 located above the stretchable band 20. Similarly, the bottom portion 16*b* may comprise the other approximately half of the stretchable band 20 and the portion of the chassis 12 located below the stretchable band 20. As shown in FIG. 5, the top portion 16*a* and the bottom portion 16*b* may define unequal portions of the chassis 12, in terms of length and/or width. In some embodiments, the top portion 16*a* and the bottom portion 16*b* comprise substantially equal lengths of the chassis 12. Either the top portion 16*a* or the bottom portion 16*b* may include substantially an entire portion of the chassis 12 covered by the stretchable band 20.

Figure 6:
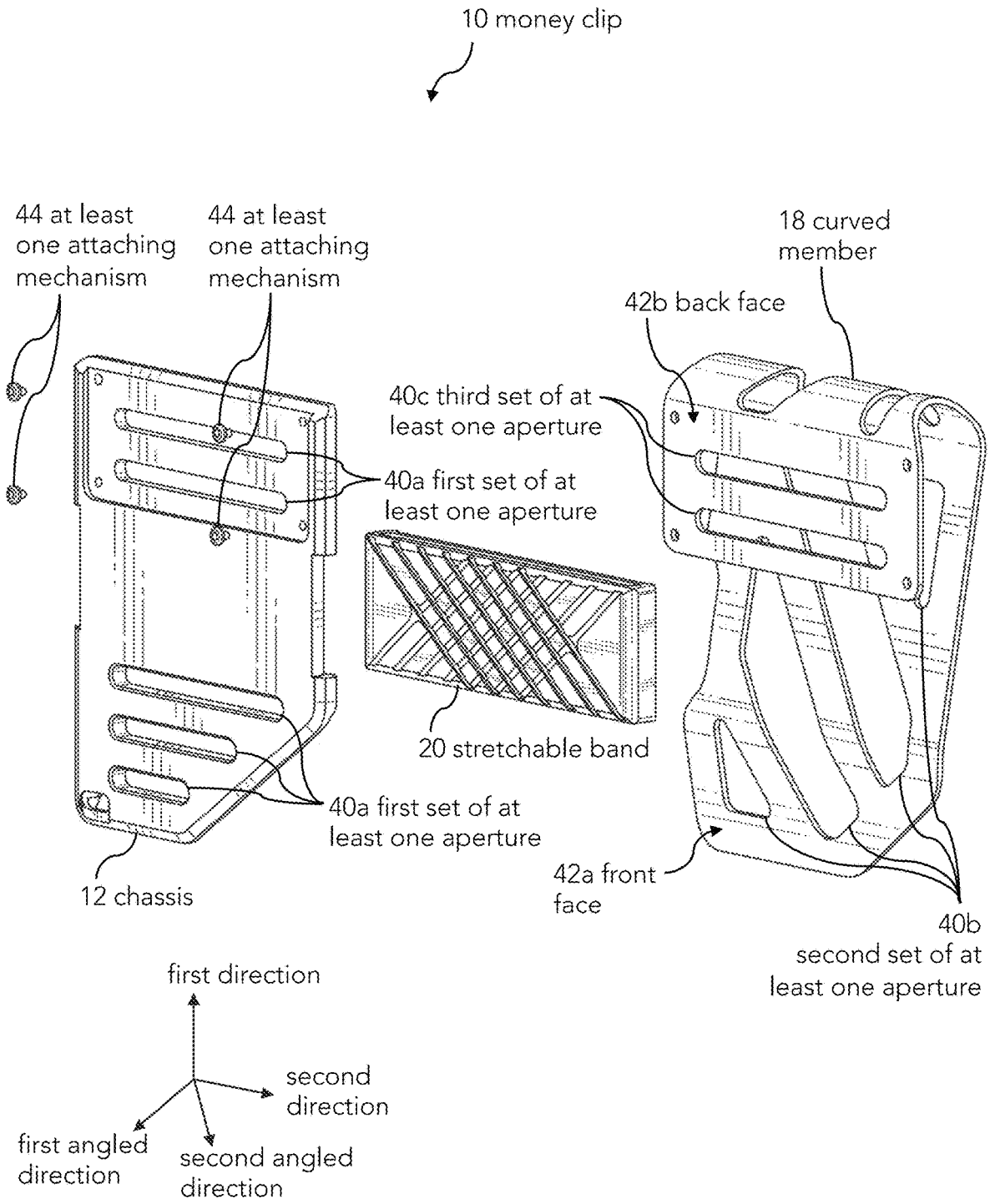
FIG. 6 illustrates an exploded view of a money clip, according to some embodiments.

FIG. 6 illustrates an exploded view of the money clip 10, according to some embodiments. As previously discussed, the money clip 10 may comprise a chassis 12, a stretchable band 20 configured to wrap around the chassis 12, and a curved member 18 configured to couple to, and curve around a top portion 16*a* of, the chassis 12. The money clip 10 may also comprise at least one attaching mechanism 44 configured to couple the curved member 18 to the chassis 12. The chassis 12 may comprise indented edges, for example the first edge 28*a* and second edge 28*b*, where the indents are configured to receive the stretchable band 20 and facilitate a substantially smooth and even perimeter of the chassis 12.

FIG. 6 also includes multiple sets of at least one aperture. In some embodiments, a first set of at least one aperture 40*a* is located on the chassis 12, as shown in FIG. 6. A second set of at least one aperture 40*b* may be located on a front face 42*a* of the curved member 18, and a third set of at least one aperture 40*c* may be located on a back face 42*b* of the curved member 18. In some embodiments, the front face 42*a* of the curved member 18 is located adjacent the first side 14*a* of the chassis 12, while the back face 42*b* is located opposite the front face 42*a* and is configured to couple to the second side 14*b* of the chassis 12.

As previously discussed, the chassis 12 may be configured to extend along a first direction and the stretchable band 20 may be configured to wrap around the chassis 12 along a second direction perpendicular to the first direction. Like the stretchable band 20, the first set of at least one aperture 40*a* and the third set of at least one aperture 40*c* may be configured to extend along the second direction. The third set of at least one aperture 40*c* may be substantially aligned with at least a portion of the first set of at least one aperture 40*a*. Specifically, in some embodiments, the portion of the first set 40*a* located in the top portion 16*a* of the chassis 12 is substantially aligned with the third set of at least one aperture 40*c*. In some embodiments, the third edge 28*c* of the chassis 12 (shown in FIG. 3), is configured to extend along a first angled direction that is not perpendicular to the first direction. The second set of at least one aperture 40*b* may be configured to extend along a second angled direction that is perpendicular to the first angled direction. In some embodiments, the second set of at least one aperture 40*b* is configured to extend along a second angled direction, rather than the second direction like the first set 40*a* and third set 40*c*, in order to offset the apertures of the first set 40*a* and second set 40*b*, and reduce the risk of a personal card(s) and/or paper bill(s) falling and/or being taken out of the money clip 10.

The first set of at least one aperture 40*a* may comprise a first aperture located on the bottom portion 16*b* of the chassis 12, a second aperture located on the bottom portion 16*b*, and a third aperture located on the bottom portion 16*b*. In some embodiments, the first aperture defines a first length, the second aperture defines a second length, and the third aperture defines a third length, wherein the third length is less than the first length and the second length, and wherein the second length is less than the first length. Stated in terms of the Figures, the first aperture may define the aperture located adjacent the stretchable band 20 while the third aperture may define the aperture located adjacent the bottom edge 28*d* of the chassis 12, and the second aperture may define the middle aperture between the first and third apertures. The first set of at least one aperture 40*a* may further comprise a fourth aperture located on the top portion 16*a* of the chassis 12 and a fifth aperture located on the top portion 16*a*, wherein the fourth aperture may define a fourth length and the fifth aperture may define a fifth length. In some embodiments, the fourth length and the fifth length are substantially equal to the first length. Each of the first aperture, second aperture, third aperture, fourth aperture, and fifth aperture may be configured to extend along the second direction.

The third set of at least one aperture 40*c* may comprise a first aperture extending along the second direction and a second aperture extending along the second direction. In some embodiments, the first aperture and second aperture of the third set 40*c* are configured to substantially align with the fourth aperture and the fifth aperture of the first set 40*a*. The first set of at least one aperture 40*a* may comprise four total apertures, with two substantially triangle-shaped apertures, as shown in FIGS. 3 and 6, and two other apertures extending along the second angled direction.

In some embodiments, at least one aperture of at least one of the first set 40*a*, the second set 40*b*, and the third set 40*c* is configured to allow a user to view at least one of at least one personal card 24 and at least one paper bill 26 coupled to the money clip 10, as shown in FIGS. 7 and 8. FIG. 7 illustrates a front view of the money clip 10 coupled to at least one paper bill 26. As previously discussed, the at least one paper bill 26 may be configured to be received and secured between the curved member 18 and the first side 14*a* of the chassis 12. The money clip 10 may be sized and configured to hold a plurality of paper bills, as shown in FIG. 7. As mentioned throughout this disclosure, in some embodiments, the money clip 10 comprises materials arranged and configured to bend, flex, etc. to accommodate different amounts of paper bills and/or personal cards, while retaining its original shape.

FIG. 8 illustrates a back view of the money clip 10 with at least one personal card 24 coupled to the money clip 10 between the stretchable band 20 and the second side 14*b* of the chassis 12. Similar to the at least one paper bill 26, the money clip 10 may be configured to receive and secure a plurality of personal cards. Like the curved member 18, the stretchable band 20 may be configured to stretch to accommodate a plurality of personal cards while retaining its original shape. Accordingly, the money clip 10 may be configured to hold, for example, 10 personal cards and/or 50 paper bills with a substantially equal amount of security as a single personal card and/or a single paper bill. It should be noted that though FIG. 7 illustrates at least one paper bill 26, and FIG. 8 illustrates at least one personal card 24, the money clip 10 may be configured to hold at least one paper bill 26, at least one personal card 24, or a combination of both on either side 14*a*, 14*b* of the chassis 12. This may allow a user of the money clip 10 to organize their items in a number of ways; for example, with paper bills on one side of the chassis 12 and personal cards on the other, small bills on one side of the chassis 12 and large bills on the other, and/or more frequently used bills and/or cards on one side of the chassis 12 and less frequently used bills and/or cards on the other.

FIGS. 9, 10A, and 10B illustrate side views of the money clip 10. As previously mentioned, the chassis 12 may be configured to extend along a first direction and the stretchable band 20 may be configured to wrap around the chassis 12 along a second direction perpendicular to the first direction. In some embodiments, at least a portion of the curved member 18 is offset from the chassis 12 along a third direction that is perpendicular to the first direction and the second direction, as shown in FIGS. 9, 10A, and 10B. The stretchable band 20 may be configured to extend along the third direction from the second side 14*b* of the chassis 12 in order to receive at least one personal card 24 and/or at least one paper bill 26, thereby retaining at least one personal card 24 and/or at least one paper bill 26 between the stretchable band 20 and the second side 14*b* of the chassis 12. FIGS. 9, 10A, and 10B also illustrate that the curved member 18 may comprise an upper portion 30*a*, a middle portion 30*b*, and a lower portion 30*c*.

It should be noted that, similar to the top portion 16*a* and bottom portion 16*b* of the chassis 12, the upper portion 30*a*, middle portion 30*b*, and lower portion 30*c* of the curved member 18 may be defined broadly. In some embodiments, as illustrated in FIGS. 9, 10A, and 10B, the middle portion 30*b* defines a portion of the curved member 18 that is configured to contact (i.e., the "contacting portion"), or substantially close to contact (e.g., spaced only 1-2 mm away from) the chassis 12. The upper portion 30*a* may comprise the portion of the curved member 18 located above the middle portion 30*b*, adjacent the top portion 16*a* of the chassis 12. The lower portion 30*c* may comprise the portion of the curved member 18 located below the middle portion 30*b*, adjacent the bottom portion 16*b* of the chassis 12. In some embodiments, the middle portion 30*b* defines the contacting portion, as well as a portion of the curved member 18 extending at least one of above and below the contacting portion.

The upper portion 30*a*, the middle portion 30*b*, and the lower portion 30*c* may define discrete fractions of the curved member 18. For example, the upper portion 30*a* may comprise substantially ½ of a total length of the curved member 18, while the middle portion 30*b* and the lower portion 30*c* may each comprise substantially ¼ of the total length of the curved member 18. In another example, the upper portion 30*a* may comprise substantially ¾ of the total length of the curved member 18, the middle portion 30*b* may comprise substantially 1/16 of the total length, and the lower portion 30*c* may comprise substantially 3/16 of the total length. In yet another example, the upper portion 30*a* may comprise substantially ½ of the total length of the curved member 18, the middle portion 30*b* may comprise substantially ⅛ of the total length, and the lower portion 30*c* may comprise substantially ⅜ of the total length. A person having ordinary skill in the art will recognize that any number of possible fractions may be suitable for defining the relative lengths of each of the upper portion 30*a*, the middle portion 30*b*, and the lower portion 30*c*.

In some embodiments, the upper portion 30*a* is physically spaced from the chassis 12 by a first length 32*a* and the lower portion 30*c* is physically spaced from the chassis 12 by a second length 32*b*, as demonstrated in FIG. 9. The middle portion 30*b* may be physically spaced from the chassis 12 by a third length that is less than the first length 32*a* and the second length 32*b*. In some embodiments, as illustrated in FIGS. 9 and 10A and mentioned above, the middle portion 30*b* is configured to contact the first side 14*a* of the chassis 12. FIG. 9 also shows that the second length 32*b* may be less than the first length 32*a*. In some embodiments, for example when the money clip 10 is coupled to a large quantity of at least one personal card 24 and/or at least one paper bill 26, at least one of the second length 32*b* and the third length may be greater than the first length 32*a*. The first length 32*a*, second length 32*b*, and third length will be discussed further with reference to FIG. 10B.

In some embodiments, the upper portion 30*a* of the curved member 18 is physically spaced along the first direction from the top edge 28*e* of the chassis 12 and along the third direction from the first side 14*a* of the chassis 12. The lower portion 30*c* may also be physically spaced along the third direction from the first side 14*a* of the chassis 12. In some embodiments, as illustrated by FIGS. 10A and 10B, the middle portion 30*b* is configured to move along the third direction. It should be noted that the term "move" may be replaced with "bend," "flex," "stretch," "expand," or any other similar term to convey how the middle portion 30*b* changes distance from the chassis 12 in order to receive at least one of at least one personal card 24 and at least one paper bill 26, thereby retaining the at least one of at least one personal card 24 and at least one paper bill 26 between the curved member 18 and the chassis 12.

The movement of the middle portion 30*b* shown in FIGS. 10A and 10B illustrates that, in some embodiments, the third length (i.e., the length between the middle portion 30*b* and the chassis 12) is less than the first length 32*a* (i.e., the length between the upper portion 30*a* and the chassis 12) and the second length 32*b* (i.e., the length between the lower portion 30*c* and the chassis 12). The money clip 10 may be arranged and configured such that the middle portion 30*b* is configured to directly contact the at least one of at least one personal card 24 and at least one paper bill 26, while at least a portion of the upper portion 30*a* and at least a portion of the lower portion 30*c* is configured to not contact the at least one of at least one personal card 24 and at least one paper bill 26. Such an arrangement may reduce wear-and-tear, prevent unnecessary bending, and generally maintain the physical quality of at least one of the at least one personal card 24 and at least one paper bill 26. The curved member 18 may be arranged and configured such that the middle portion 30*b* has an extensive range of motion along the third direction, in order to accommodate a single paper bill and/or personal card, or a large quantity of paper bills and/or personal cards.

Figure 11:
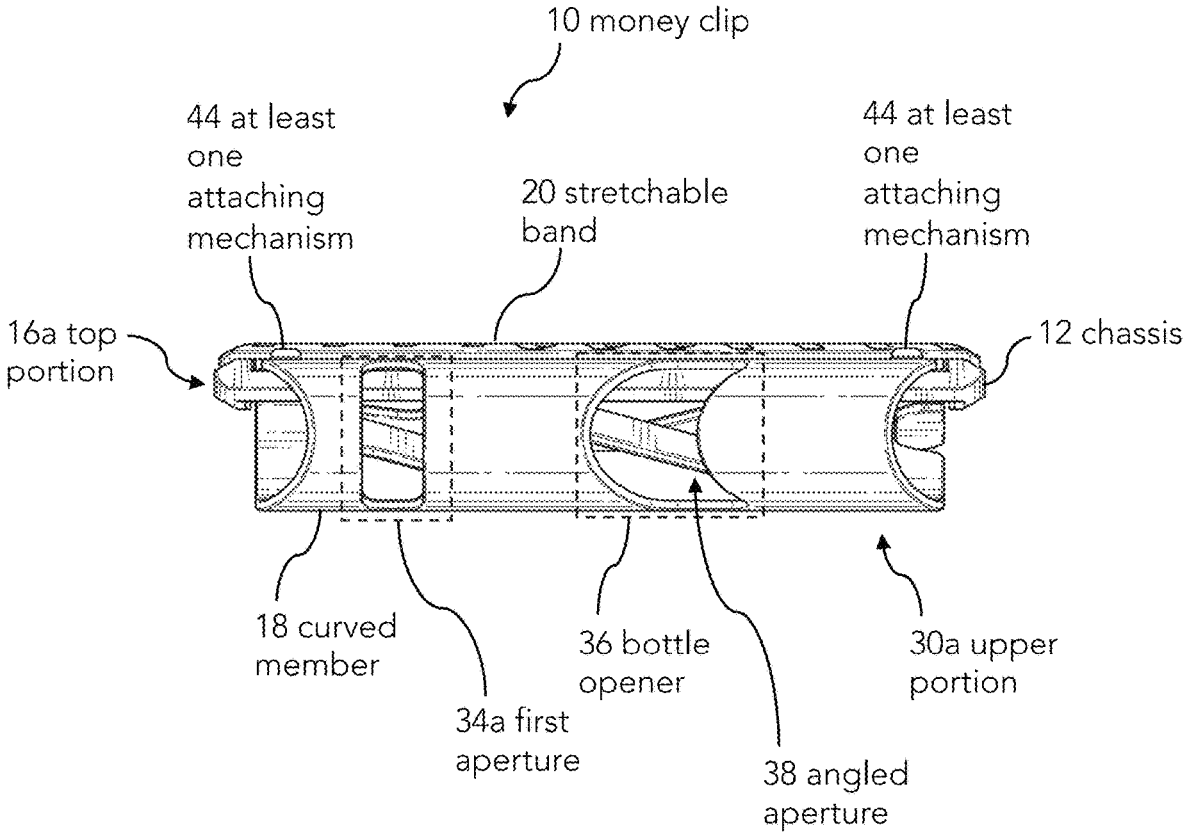
FIG. 11 illustrates a top view of a money clip, according to some embodiments.

Turning now to FIG. 11, a top view of the money clip 10 is shown, including the first aperture 34*a* and the bottle opener 36 located on the upper portion 30*a* of the curved member 18. As mentioned with respect to FIG. 3, the bottle opener 36 may define an angled aperture 38. The angled aperture 38 is shown in FIG. 11 as defining a shape similar to a crescent moon, with wider top and bottom portions. In some embodiments, the bottle opener 36 is configured to receive a bottle cap such that a bottom edge of the bottle cap fits under a right side (i.e., the convex portion) of the angled aperture 38, and the money clip 10 is moved away from the bottle so that the leverage of the convex portion under the bottom edge pulls off the bottle cap. In contrast to the bottle opener 36 defining an angled aperture 38, the first aperture 34*a* may define an even, symmetrical, elongated oval shape. In some embodiments, the first aperture 34*a* defines a circular shape, a rectangular shape, or any number of suitable shapes. The first aperture 34*a* may be sized and configured to receive at least one keyring, clip, lanyard, tether, or other similar mechanism, as discussed with reference to FIGS. 3-5. Though shown in the Figures with only the first aperture 34*a* and the bottle opener 36, the upper portion 30*a* of the curved member 18 may comprise at least one additional aperture. In some embodiments, the bottle opener 36 and the first aperture 34*a* are sized and configured to minimize exposure of the at least one personal card 24 and/or at least one paper bill 26 to risk of falling out of, or being removed from, the money clip 10.

In some embodiments, as previously discussed in this disclosure, the chassis 12 comprises aluminum and the curved member 18 comprises titanium. More specifically, the chassis 12 may comprise CNC-machined, 6061 aerospace aluminum, and the curved member 18 may comprise a titanium alloy heat-treated to prevent cracking while retaining flexibility and shape memory. As such, the titanium alloy may be configured so that the curved member 18 is configured to repeatedly flex (or bend, move, extend, etc.) without losing its shape. In some embodiments, the use of aluminum and titanium materials in the construction of the money clip 10 enables the money clip 10 to serve as a radio frequency identification ("RFID")-blocking money clip 10. For example, if at least one personal card 24 (e.g., an RFID or "chip" card) is inserted with the chip located adjacent the top portion 16*a* of the chassis 12, then the chassis 12 and the curved member 18 may form a metal cage to substantially surround the chip and protect the at least one personal card 24 from malicious RFID reading technology.

The money clip 10 may include a level of customization to suit individual users. In some embodiments, the chassis 12 comprises different possible colors of aluminum. For example, the chassis 12 may comprise gray aluminum, black aluminum, gold aluminum, or any other color. In addition, the stretchable band 20 may comprise different colors such that a user may "mix and match" by choosing from several color options for both the chassis 12 and the stretchable band 20. The curved member 18 may also include different color options.

As indicated in FIGS. 7 and 8, the money clip 10 may be sized larger than at least one personal card 24 and/or at least one paper bill 26, when the at least one paper bill 26 is in a folded position. At least one personal card 24 may include a standard driver's license, other identification card, credit card, gift card, or the like, defining a width of about 3.37 inches, a height of about 2.125 inches, and a thickness of about 1 millimeter. The at least one paper bill 26 may include paper currency from any nation and/or group of nations, in addition to business cards, paper coupons, and other paper items (e.g., grocery list, event ticket, claim check, parking pay stub, etc.). In some embodiments, the money clip 10 defines a length of about 3.85 inches, a width of about 3 inches, and a variable depth/thickness, depending on a quantity of personal cards and/or paper bills coupled to the money clip 10. The money clip 10 alone, without any personal cards and/or paper bills, may define a depth/thickness of about 16.5 millimeters at an upper portion 30*a* of the curved member 18, a depth/thickness of about 10.5 millimeters at a lower portion 30*c* of the curved member 18, and a weight of about 2.8 ounces. The money clip 10 may be configured to hold up to eighty paper bills (e.g., U.S. bills of any dollar amount, folded in half), with fifty bills between the curved member 18 and the chassis 12, and thirty bills between the stretchable band 20 and the chassis 12. The money clip 10 may be configured to hold up to 26 personal cards, with 16 cards between the curved member 18 and the chassis 12, and 10 cards between the stretchable band 20 and the chassis 12. Exact quantities of personal cards and/or paper bills that may be held by the money clip 10 will depend on the individual thickness of each card and/or bill, and the quantities listed here are included as non-limiting examples. In some embodiments, the stretchable band 20 is configured to stretch up to 10 millimeters.

It should be noted that the dimensions of the money clip 10 included in this disclosure are intended to form a non-limiting example. The money clip 10 may be larger than at least one of the listed dimensions. The money clip 10 may be smaller than at least one of the listed dimensions.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

The term "about" is used to mean "approximately." For example, the disclosure includes, "At least one personal card 24 may include a standard driver's license, other identification card, credit card, gift card, or the like, defining . . . a thickness of about 1 millimeter." In this context, "about one millimeter" is used to mean "approximately" one millimeter. A range of 0.5 millimeters to 1.5 millimeters falls into an acceptable range and interpretation of "about one millimeters," as used in this disclosure.

The term "substantially" is used to mean "completely" or "nearly completely." For example, the disclosure includes, "Specifically, in some embodiments, the portion of the first set 40*a* located in the top portion 16*a* of the chassis 12 is substantially aligned with the third set of at least one aperture 40*c*." In this context, "substantially aligned" is used to mean that the portion of the first set of at least one aperture 40*a* located in the top portion 16*a* may be "completely" aligned or "nearly completely" aligned with the third set of at least one aperture 40*c*, and fall into the understanding of "substantially" as used in this disclosure. The first set 40*a* and third set 40*c* may be offset from one another by up to 25%, and still be considered "substantially aligned."

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A money clip, comprising:

a chassis defining a first side, a second side located opposite the first side, a top portion, and a bottom portion located opposite the top portion;

a curved member mechanically coupled to the second side of the chassis adjacent the top portion, the curved member configured to curve around the top portion to the first side of the chassis, the curved member terminating adjacent the bottom portion;

a stretchable band configured to wrap around the chassis, a first portion of the stretchable band located between the first side of the chassis and the curved member and a second portion of the stretchable band located on the second side of the chassis; and a bottle opener located on the curved member adjacent the top portion of the chassis, the bottle opener defining an angled aperture configured to receive at least a portion of a bottle cap.

2. The money clip of claim 1, wherein the stretchable band is configured to receive and retain at least one of at least one personal card and at least one paper bill to the chassis.

3. The money clip of claim 2, wherein the stretchable band is configured to provide friction between the curved member and the first side of the chassis to enable the money clip to retain the at least one of at least one personal card and at least one paper bill between the curved member and the first side of the chassis.

4. The money clip of claim 2, wherein the chassis defines a first edge and a second edge located opposite the first edge, each of the first edge and the second edge configured to extend between the top portion and the bottom portion, wherein the stretchable band is configured to wrap around the chassis such that it contacts at least one of the first side, the second side, the first edge, and the second edge.

5. The money clip of claim 4, wherein the first edge defines a length less than a second edge, the chassis further defining a third edge configured to extend from a bottom portion of the first edge to a bottom edge of the chassis.

6. The money clip of claim 1, wherein the chassis extends along a first direction and the stretchable band wraps around the chassis along a second direction perpendicular to the first direction, wherein at least a portion of the curved member is offset from the chassis along a third direction that is perpendicular to the first direction and the second direction.

7. The money clip of claim 6, the curved member comprising an upper portion, a middle portion, and a lower portion, wherein the upper portion is physically spaced from the chassis by a first length, the lower portion is physically spaced from the chassis by a second length, and the middle portion is physically spaced from the chassis by a third length that is less than the first length and the second length.

8. The money clip of claim 7, wherein the middle portion is configured to contact the first side of the chassis.

9. The money clip of claim 7, wherein the second length is less than the first length.

10. The money clip of claim 7, wherein the upper portion of the curved member is physically spaced along the first direction from a top edge of the chassis and along the third direction from the first side of the chassis, and wherein the lower portion of the curved member is physically spaced along the third direction from the first side of the chassis, wherein the middle portion is configured to move along the third direction to receive at least one of at least one personal card and at least one paper bill, thereby retaining the at least one of at least one personal card and at least one paper bill between the curved member and the first side of the chassis.

11. The money clip of claim 1, further comprising a first aperture located on the curved member adjacent the top portion of the chassis and a second aperture located on the chassis adjacent the bottom portion, the first aperture and the second aperture configured to receive at least one attaching member, wherein the at least one attaching member comprises at least one of a keyring, a lanyard, a clip, and a tether.

12. The money clip of claim 1, further comprising a first set of at least one aperture located on the chassis, a second set of at least one aperture located on a front face of the curved member, and a third set of at least one aperture located on a back face of the curved member, wherein the front face is located adjacent the first side of the chassis and the back face is coupled to the second side of the chassis, and wherein the first set of at least one aperture is substantially aligned with the third set of at least one aperture, the at least one aperture of at least one of the first set, the second set, and the third set configured to allow a user to view at least one of at least one personal card and at least one paper bill coupled to the money clip.

13. The money clip of claim 12, wherein the chassis defines a first edge and a second edge located opposite the first edge, wherein each of the first edge and the second edge is configured to extend along a first direction between the top portion and the bottom portion, the chassis further defining a third edge configured to extend along a first angled direction that is not perpendicular to the first direction, wherein the stretchable band is configured to wrap around the chassis along a second direction perpendicular to the first direction, wherein the first set of at least one aperture and the third set of at least one aperture are configured to extend along the second direction, and wherein the second set of at least one aperture is configured to extend along a second angled direction that is perpendicular to the first angled direction.

14. The money clip of claim 13, wherein the chassis further defines a top edge extending along the second direction between the first edge and the second edge, and a bottom edge extending along the second direction between the third edge and the second edge, wherein at least a portion of at least one of the first edge, the second edge, the third edge, the top edge, and the bottom edge comprises a beveled edge.

15. The money clip of claim 14, the bottom edge comprising a bottom aperture defining a first side located adjacent the first side of the chassis and a second side located adjacent the second side of the chassis, wherein the first side of the bottom aperture does not comprise the beveled edge and the second side of the bottom aperture comprises the beveled edge.

16. The money clip of claim 15, wherein the bottom aperture extends along the second direction.

17. The money clip of claim 16, wherein the bottom aperture defines an oval shape having a height and a width, wherein the height is configured to extend along the first direction and the width is configured to extend along the second direction.

18. The money clip of claim 1, wherein the chassis comprises aluminum, the curved member comprises a titanium alloy, and the stretchable band comprises silicone.

19. The money clip of claim 1, wherein a first edge and a second edge of the chassis extend along a first direction, the stretchable band wraps around the chassis along a second direction perpendicular to the first direction, and a third edge of the chassis extends along a first diagonal direction that is not perpendicular to the first direction or the second direction, the curved member comprises an upper portion, a middle portion, and a lower portion, wherein the upper portion and the lower portion are configured to be physically spaced from the first side of the chassis along a third direction that is perpendicular to the first direction and the second direction, the upper portion comprising a bottle opener, wherein the stretchable band is configured to receive and retain at least one of at least one personal card and at least one paper bill, and wherein the stretchable band is configured to provide friction between the curved member and the first side of the chassis to enable the money clip to retain the at least one of at least one personal card and at least one paper bill between the curved member and the first side of the chassis.

20. The money clip of claim 19, further comprising a first set of at least one aperture located on the chassis, a second set of at least one aperture located on a front face of the curved member, and a third set of at least one aperture located on a back face of the curved member, wherein the front face is located adjacent the first side of the chassis and the back face is coupled to the second side of the chassis, the first set comprising at least one aperture located on a bottom portion of the chassis and at least one aperture located on a top portion of the chassis, each aperture of the first set extending along the second direction, the second set comprising at least one aperture extending along a second angled direction perpendicular to the first angled direction, the third set comprising at least one aperture extending along the second direction, wherein the first set comprises a first aperture located on the bottom portion, the first aperture defining a first length, a second aperture located on the bottom portion, the second aperture defining a second length, and a third aperture located on the bottom portion, the third aperture defining a third length, wherein the third length is less than the first length and the second length and wherein the second length is less than the first length, wherein the first set further comprises a fourth aperture located on the top portion, the fourth aperture defining a fourth length, and a fifth aperture located on the top portion, the fifth aperture defining a fifth length, wherein the fourth length and the fifth length are substantially equal to the first length, wherein the second set comprises two apertures extending along the second angled direction, and wherein the third set comprises two apertures extending along the second direction, wherein each of the two apertures is substantially aligned with the fourth aperture and the fifth aperture.

* * * * *